US009518404B2

(12) United States Patent
Volin

(10) Patent No.: US 9,518,404 B2
(45) Date of Patent: Dec. 13, 2016

(54) FENCE POST SYSTEM

(71) Applicant: Dee Volin, Fairview, OR (US)

(72) Inventor: Dee Volin, Fairview, OR (US)

( * ) Notice: Subject to any disclaimer, the term of this patent is extended or adjusted under 35 U.S.C. 154(b) by 0 days.

(21) Appl. No.: 15/140,463

(22) Filed: Apr. 27, 2016

(65) Prior Publication Data

US 2016/0319565 A1 Nov. 3, 2016

Related U.S. Application Data

(60) Provisional application No. 62/155,350, filed on Apr. 30, 2015.

(51) Int. Cl.

| | |
|---|---|
| ***E04H 17/14*** | (2006.01) |
| ***E04H 17/20*** | (2006.01) |
| ***E04B 1/72*** | (2006.01) |
| ***E04H 12/22*** | (2006.01) |
| *E04H 17/00* | (2006.01) |

(52) U.S. Cl.

CPC ..... *E04H 17/1421* (2013.01); *E04B 1/72* (2013.01); *E04H 12/2253* (2013.01); *E04H 12/2269* (2013.01); *E04H 12/2292* (2013.01); *E04H 17/20* (2013.01); *E04H 2017/006* (2013.01)

(58) Field of Classification Search

CPC .. E04H 17/14; E04H 17/1413; E04H 17/1417; E04H 17/1421; E04H 17/1447; E04H 17/1482; E04H 17/20; E04H 17/22

See application file for complete search history.

(56) References Cited

U.S. PATENT DOCUMENTS

| | | | | |
|---|---|---|---|---|
| 3,269,553 | A | 8/1966 | Ruhnke | |
| 3,524,627 | A | 8/1970 | Boyanton | |
| 3,615,110 | A | 10/1971 | Fugate | |
| 3,669,480 | A | 6/1972 | Fugate | |
| 3,863,900 | A | 2/1975 | Dagiel | |
| 4,007,919 | A | 2/1977 | Totten | |
| 4,369,953 | A | 1/1983 | Greiner | |
| 4,471,947 | A | 9/1984 | Osborne | |
| 4,542,885 | A | 9/1985 | Rossiter | |
| 4,616,950 | A | 10/1986 | Morris | |
| 4,899,991 | A | 2/1990 | Brunkan | |
| 4,965,980 | A | 10/1990 | Leavens | |
| 4,995,590 | A | 2/1991 | Close | |
| 5,071,280 | A | 12/1991 | Turner | |
| 5,160,211 | A | 11/1992 | Gilb | |
| 5,238,321 | A | 8/1993 | Jarjoura | |
| 5,297,890 | A | 3/1994 | Commins | |
| 5,560,588 | A | 10/1996 | Hilliard | |
| 5,624,045 | A | 4/1997 | Highsmith | |
| 5,730,426 | A * | 3/1998 | Tu | E04H 17/161 256/32 |

(Continued)

*Primary Examiner* — Daniel Wiley

(57) ABSTRACT

Disclosed herein is a fence post system. The system is comprised of a U-shaped-post system having L-shaped-bracket openings which are punched thereon, which also have an anti-warping-rib system, and an anti-torsion-rib system. Further, there are left-and-right-bracket systems molded to both sides of the fence post, which have upper-and-lower-flange systems molded to both ends. Additionally there are L-shaped bracket systems inserted into the L-shaped-bracket openings respectively, with a strut system which is seated on the U-shaped-post system. There may further be a board system screwed to the strut system.

20 Claims, 52 Drawing Sheets

(56) References Cited

U.S. PATENT DOCUMENTS

| | | | |
|---|---|---|---|
| 5,795,503 | A | 8/1998 | Krake |
| 5,913,508 | A | 6/1999 | Eades |
| 6,173,945 | B1 | 1/2001 | Lindsey |
| 6,299,143 | B1 | 10/2001 | Valentine |
| 6,341,764 | B1 | 1/2002 | Conner |
| 6,530,561 | B2 | 3/2003 | Larsen |
| 6,631,887 | B1 | 10/2003 | Walmsley |
| 6,648,304 | B1 | 11/2003 | Zhu |
| 6,824,123 | B2 | 11/2004 | Larsen |
| 7,032,891 | B2 | 4/2006 | Rowley |
| 7,100,904 | B2 | 9/2006 | Kim |
| 7,396,002 | B1 | 7/2008 | Gibbs |
| 7,407,152 | B2 | 8/2008 | Platt |
| 7,571,897 | B2 | 8/2009 | Heinz |
| 7,784,744 | B2 | 8/2010 | Becker |
| 8,453,342 | B2 | 6/2013 | Knudsen |
| 8,783,662 | B1 | 7/2014 | Russo |
| 8,899,555 | B2 | 12/2014 | Sherstad |
| 8,919,742 | B2 | 12/2014 | Williams, Sr. |
| 8,931,761 | B2 | 1/2015 | Langenwalter |
| 9,027,909 | B1 | 5/2015 | Peyton |
| 9,151,074 | B2 | 10/2015 | Walters |
| 9,212,504 | B1 | 12/2015 | Mobile, Sr. |
| 9,228,372 | B2 | 1/2016 | Bertato |
| 9,234,368 | B2 | 1/2016 | Zhu |
| 9,255,396 | B2 | 2/2016 | Eberhart |
| 9,309,690 | B1 | 4/2016 | Payne |
| 2007/0189875 | A1 | 8/2007 | Ooyama |
| 2008/0029748 | A1 | 2/2008 | Ford |
| 2008/0042116 | A1 | 2/2008 | Buckley |
| 2013/0175488 | A1 | 7/2013 | Burt |

* cited by examiner

Fig. 24A
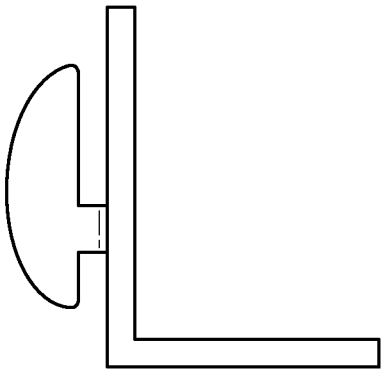
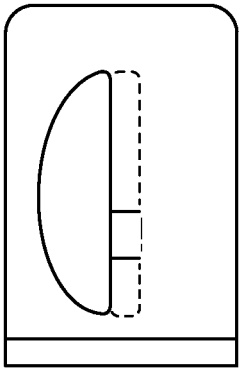
Fig. 24B
Fig. 24C
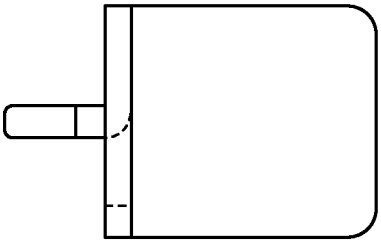

FENCE POST SYSTEM

STATEMENT REGARDING FEDERALLY SPONSORED RESEARCH OR DEVELOPMENT

N/A

REFERENCE TO SEQUENTIAL LISTING, A TABLE, OR A COMPUTER PROGRAM LISTING APPENDIX SUBMITTED ON A COMPACT DISC

N/A

CROSS-REFERENCE TO RELATED APPLICATIONS & CONTINUITY DATA

Provisional Patent Application No. 62/155,350 was filed on 2015 Apr. 30 and is hereby incorporated in its entirety.

FIELD OF THE INVENTION

The present invention relates to fence posts.

BACKGROUND OF THE INVENTION

A number of fence posts have been introduced.

U.S. Pat. No. 3,863,900, issued 1975 Feb. 4, to Richard T. Dagiel, discloses a guard rail assembly including a stanchion bracket which is designed for removable attachment to the outer edge of a concrete floor slab and, in combination with similar stanchion brackets, serves to support a series of upright stanchions which, in turn, are designed to support a wooden safety guard rail;

U.S. Pat. No. 4,471,947, issued 1984 Sep. 18, to Charles W. Osborne, discloses a modular fence construction, which includes a plurality of panels which extend between adjacent fence posts and are releasably connected to the posts;

U.S. Pat. No. 5,297,890, issued 1994 Mar. 29, to Alfred D. Commins, discloses a wood-to-pipe connection, in which a single sheet metal connector and a single threaded straight bolt are used to connect a wood frame member to an elongated pipe member;

U.S. Pat. No. 5,913,508, issued 1999 Jun. 22, to Richard Eades, discloses a group of posts, rails, right and left side L shaped post to rail connectors, base plates, and toeboard-holding plates to allow temporary or permanent installation of a safety guard rail system with two or more guard rails that may be used as a guard rail on stairways or on flat surfaces;

U.S. Pat. No. 6,631,887, issued 2003 Oct. 14, to Roger Walmsley, discloses a rail, which comprises an elongated channel with a top wall and two side walls, each of the side walls being of substantial U-section with an outer part connected to the top wall and an inner in-turned part, the top wall having a series of apertures through which respective tubular fence members are fitted;

U.S. Pat. No. 7,407,152, issued 2008 Aug. 5, to Robert E. Platt, discloses a fencing system, which includes a post mount mountable on a foundation and having a vertically extending outer surface. A post insert sits atop the post mount and has an outer surface disposed outwardly of the post mount outer surface. The post insert has an upper sidewall which extends upwardly of the post mount and defines an upwardly opening cavity;

U.S. Pat. No. 8,931,761, issued 2015 Jan. 13, to Duane E. Langenwalter, discloses a customizable decorative fencing system. A plurality of stakes, configured to be driven into the ground at selected positions, have projecting portions projecting above the ground. Posts have cavities in lower distal ends thereof. Any stake projecting portion is configured to slide into any post cavity, and be frictionally, removably, interchangeably retained therein;

U.S. Pat. No. 9,212,504, issued 2015 Dec. 15, to Raymond A. Mobile, Sr., discloses a fence post construction, which is constructed from a load-bearing material and has a post axis, an upper post end, and a lower post end. The material construction is formed to include laterally opposed wing portions extending outwardly relative to the post axis, each of which preferably include a series of laterally paired notch arrangements;

The prior art has failed to solve many problems associated with such fence-posts. Specifically the prior art does not mention or disclose any fence-posts, each having upper flange body 121 and upper flange body 123. Therefore, the prior art of fence-posts do not allow all the upper struts of the fence to sit and run continuously on the novel fence posts described herein (instead, having to be cut at the work sites to fit between every two fence posts like the prior-art fence posts require) in order to eliminate all the countless, tedious, hazardous cuttings of the struts to fit between every two fence posts. The invention herein allows fences to be installed a lot faster and safer, to therefore save material, production costs, labor, time, and money, and to therefore eliminate countless finger-cutting injuries and personal injuries (FIG. 1 (Prior Art).

The prior art does not allow all the upper struts to sit and run continuously on the top ends of the fence posts which eliminates the need for an extra person to hold a far end of a strut up for another worker to screw the other end to the fence post. The prior art does not allow the fence to be built by one person (Prior-art fences can't be built by one person. They require multiple persons to work together at the same time to build them) (FIG. 1 (Prior Art).

The prior art does not allow for the upper struts to sit and run continuously on the strongest portions of the fence post, which are the top ends (central section 102, left-flank section 103, and right-flank section 104). Instead the prior art posts are screwed to the weakest portion of the fence post, which is bracket body 116 or 118) to allow the strongest portions of the fence post to carry the weight of the fence. This prevents its weakest portion (bracket body 116 or 118) from bending and warping under the weight of the fence panels and the fence, and to prevent the fence panels and the fence from sagging under its own weight (FIG. 1 (Prior Art).

The prior art further does not allow for all the upper struts to cover all empty channels 105 inside the fence post to prevent hazardous beehives and hazardous nests from being built by bees and wasps (FIGS. 2 (Prior Art) and 3 (Prior Art).

Nothing in the prior art mentions or discloses any fence-posts, each having a lower flange body 126 and 128. Therefore, the prior art cannot function to additionally secure the fence post in the cement foundation or in the ground. Such additional stability helps to resist hurricane and storm wind pulling the fence post out of the foundation or the ground, and to therefore prevent property damages and personal injuries (FIG. 4C).

The prior art does not disclose an upper flange body 121 and upper flange body 123, which allows the current invention to be used in either direction, right side up or upside down. (FIGS. 4C and 5).

No prior art mention or disclose any fence-posts, each having L-shaped bracket system 130 and L-shaped bracket system 134. Therefore, the prior art cannot function as double jaws to lock the fence struts in between providing greater stability (FIGS. 11A, 11B, 11C, and 11D).

The prior art does not disclose fence posts such as the invention herein, which utilizes double clamps to lock the fence struts securing the left-flank section 103, right-flank section 104, vertical-bracket body 116, and vertical-bracket body 118. This arrangement allows the invention herein to resist hurricane and storm wind, to therefore prevent hurricane and storm wind from pulling the fence post out of cement foundation or the ground, and to therefore prevent property damages and personal injuries (FIGS. 11A, 11B, 11C, and 11D).

Thus, there remains a considerable need for fence posts that provide the aforementioned functions.

BRIEF SUMMARY OF THE INVENTION

The invention herein substantially departs from the conventional concepts and designs of the prior art. In doing so, the new invention provides a unique fence post with the following key features: the post is continuous with the strut atop the fence post, the channels are sealed, the strut is aligned and locked, and the post has a flange that locks the foundation. The fence-post system has many unique and significant features, functions, and advantages, which overcome all the disadvantages of the prior art, as follows:

The invention herein allows all the upper struts of the fence to sit and run continuously on the novel fence posts described herein (instead, having to be cut at the work sites to fit between every two fence posts like the prior-art fence posts require) in order to eliminate all the countless, tedious, hazardous cuttings of the struts to fit between every two fence posts. The invention herein allows fences to be installed a lot faster and safer, to therefore save material, production costs, labor, time, and money, and to therefore eliminate countless finger-cutting injuries and personal injuries (FIG. 1 (Prior Art).

With the invention herein all the upper struts to sit and run continuously on the top ends of the fence posts which eliminates the need for an extra person to hold a far end of a strut up for another worker to screw the other end to the fence post. The fence may be built by one person (Prior-art fences can't be built by one person. They require multiple persons to work together at the same time to build them) (FIG. 1 (Prior Art).

The upper struts of the fence sit and run continuously on the strongest portions of the fence post, which are the top ends (central section 102, left-flank section 103, and right-flank section 104). This prevents its weakest portion (bracket body 116 or 118) from bending and warping under the weight of the fence panels and the fence, and to prevent the fence panels and the fence from sagging under its own weight (FIG. 1 (Prior Art).

The invention allows for all the upper struts to cover all empty channels 105 inside the fence post to prevent hazardous beehives and hazardous nests from being built by bees and wasps (FIGS. 2 (Prior Art) and 3 (Prior Art).

The fence post have a lower flange body 126 and 128. These help to additionally secure the fence post in the cement foundation or in the ground. Such additional stability helps to resist hurricane and storm wind pulling the fence post out of the foundation or the ground, and to therefore prevent property damages and personal injuries (FIG. 4C).

The upper flange body 121 and upper flange body 123, allow the current invention to be used in either direction, right side up or upside down. (FIGS. 4C and 5). No prior art mention or disclose any fence-posts, each having L-shaped bracket system 130 and L-shaped bracket system 134. Therefore, the prior art cannot function as double jaws to lock the fence struts in between providing greater stability (FIGS. 11A, 11B, 11C, and 11D).

The invention herein further utilizes double clamps to lock the fence struts securing the left-flank section 103, right-flank section 104, vertical-bracket body 116, and vertical-bracket body 118. This arrangement allows the invention herein to resist hurricane and storm wind, to therefore prevent hurricane and storm wind from pulling the fence post out of cement foundation or the ground, and to therefore prevent property damages and personal injuries (FIGS. 11A, 11B, 11C, and 11D).

Other objects and advantages of the present invention will become apparent from a consideration of the accompanying drawings and ensuing description.

BRIEF DESCRIPTION OF THE DRAWINGS

FIGS. 24A, 24B, and 24C illustrate side, front, and top views of an equivalent of the right-side-up L-shaped bracket system or the upside-down L-shaped bracket system.

DETAILED DESCRIPTION OF THE PREFERRED EMBODIMENTS

Figure 1:
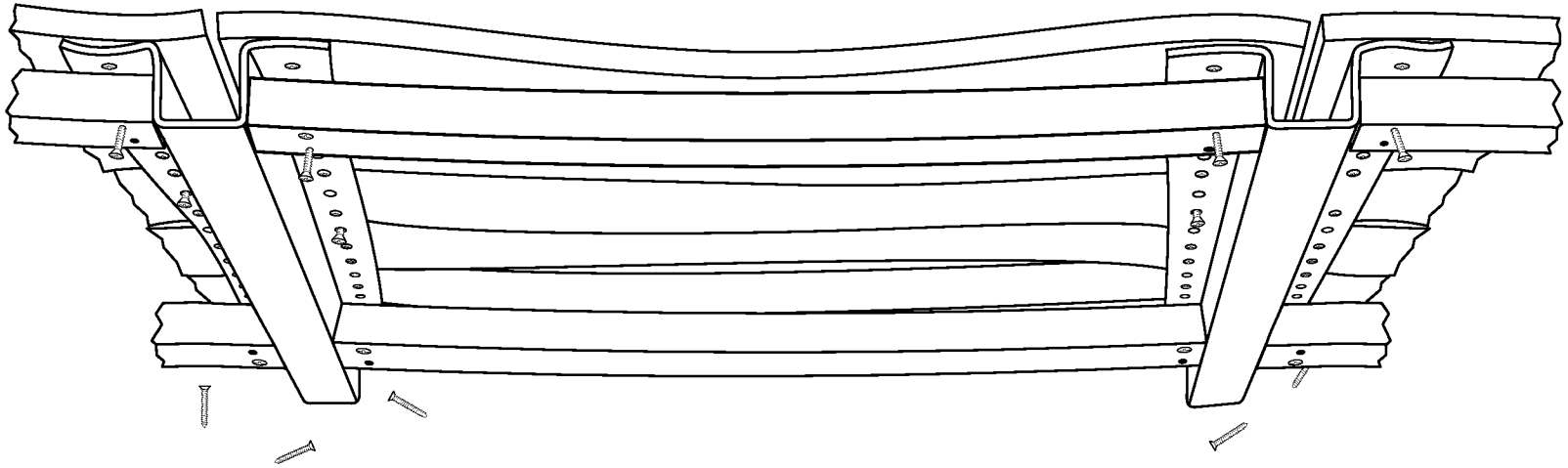
Fig. 1 (Prior Art)
FIGS. 1 (Prior Art), 2 (Prior Art), and 3 (Prior Art) illustrate perspective views of the disadvantages of the prior art.
Figure 2:
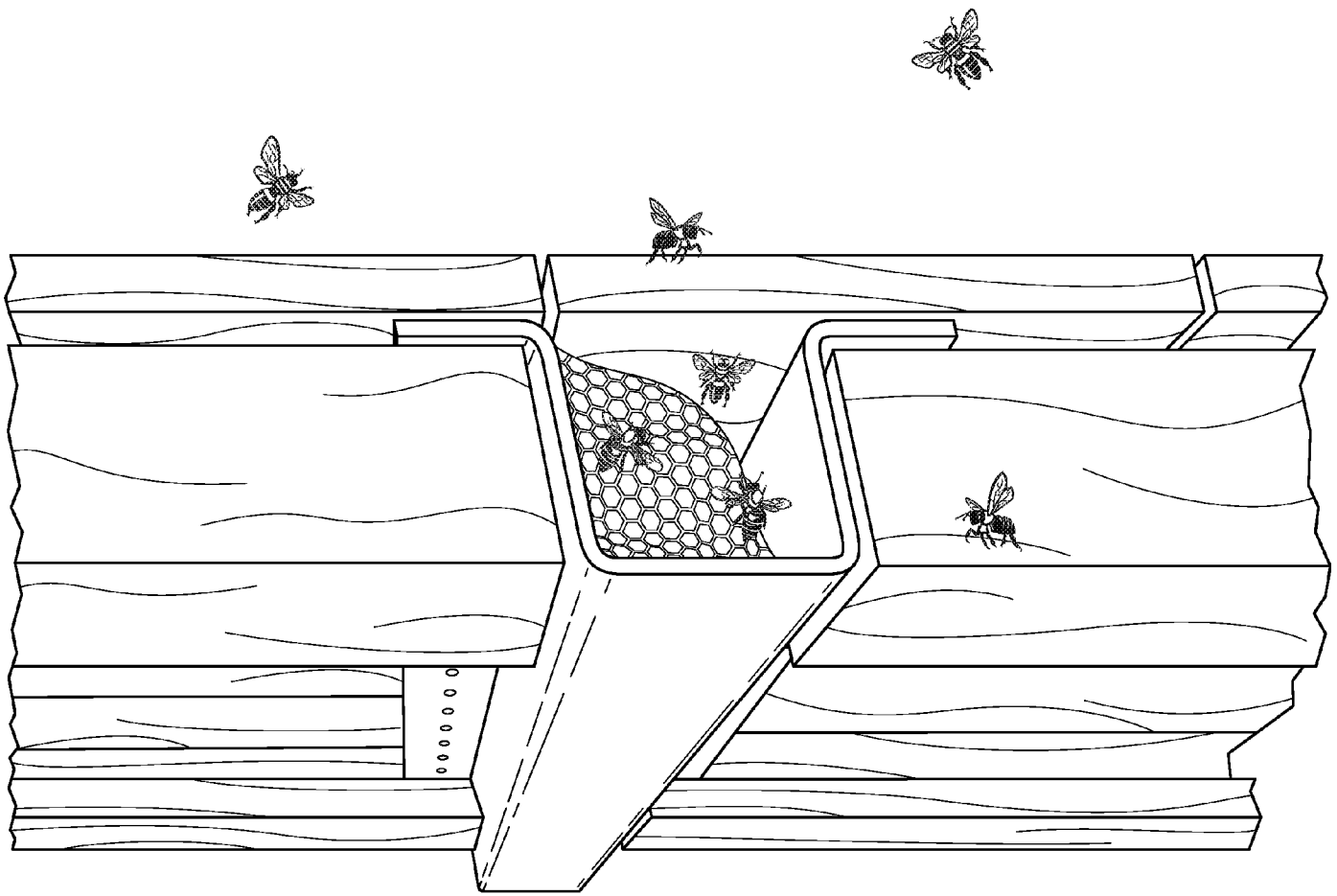
Fig. 2 (Prior Art)
Figure 3:
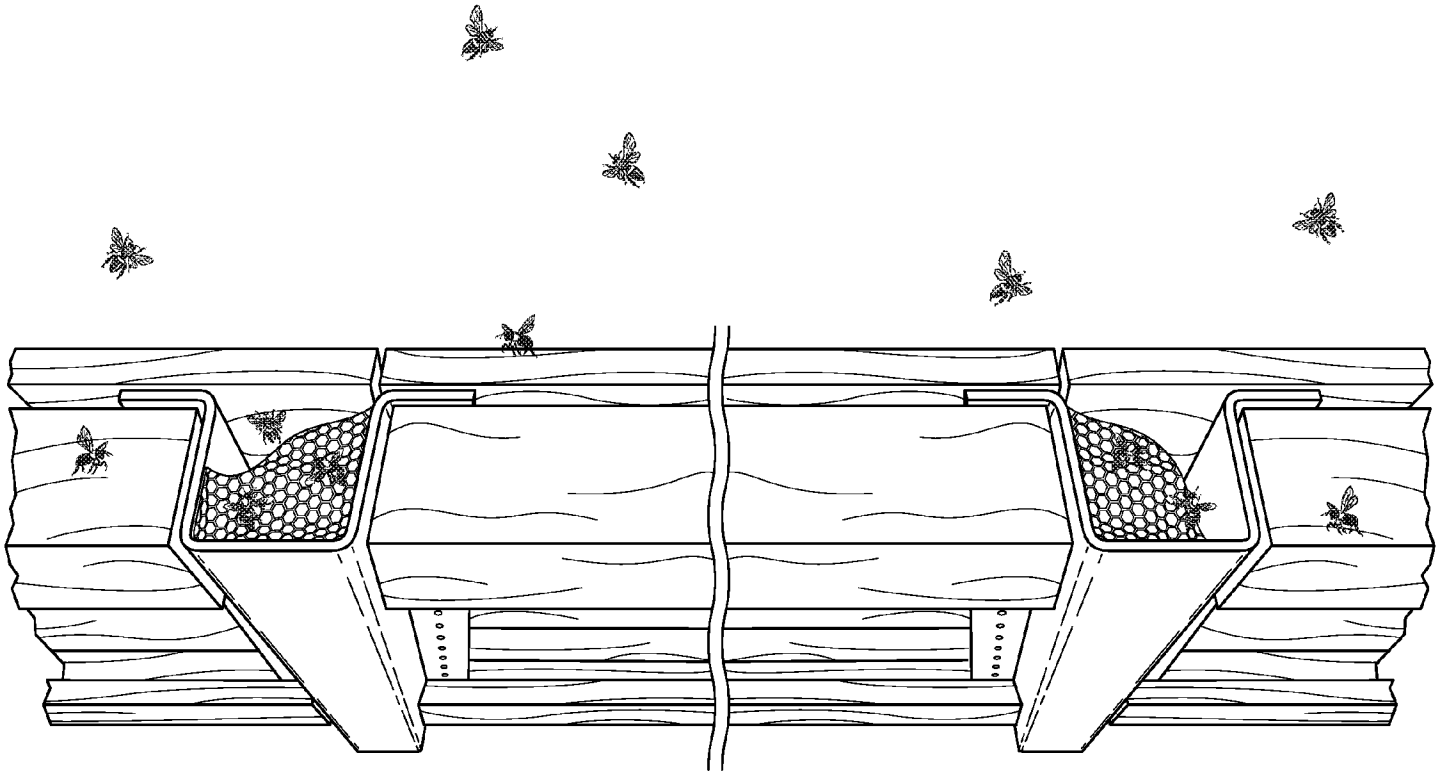
Fig. 3 (Prior Art)
Figure 4A:
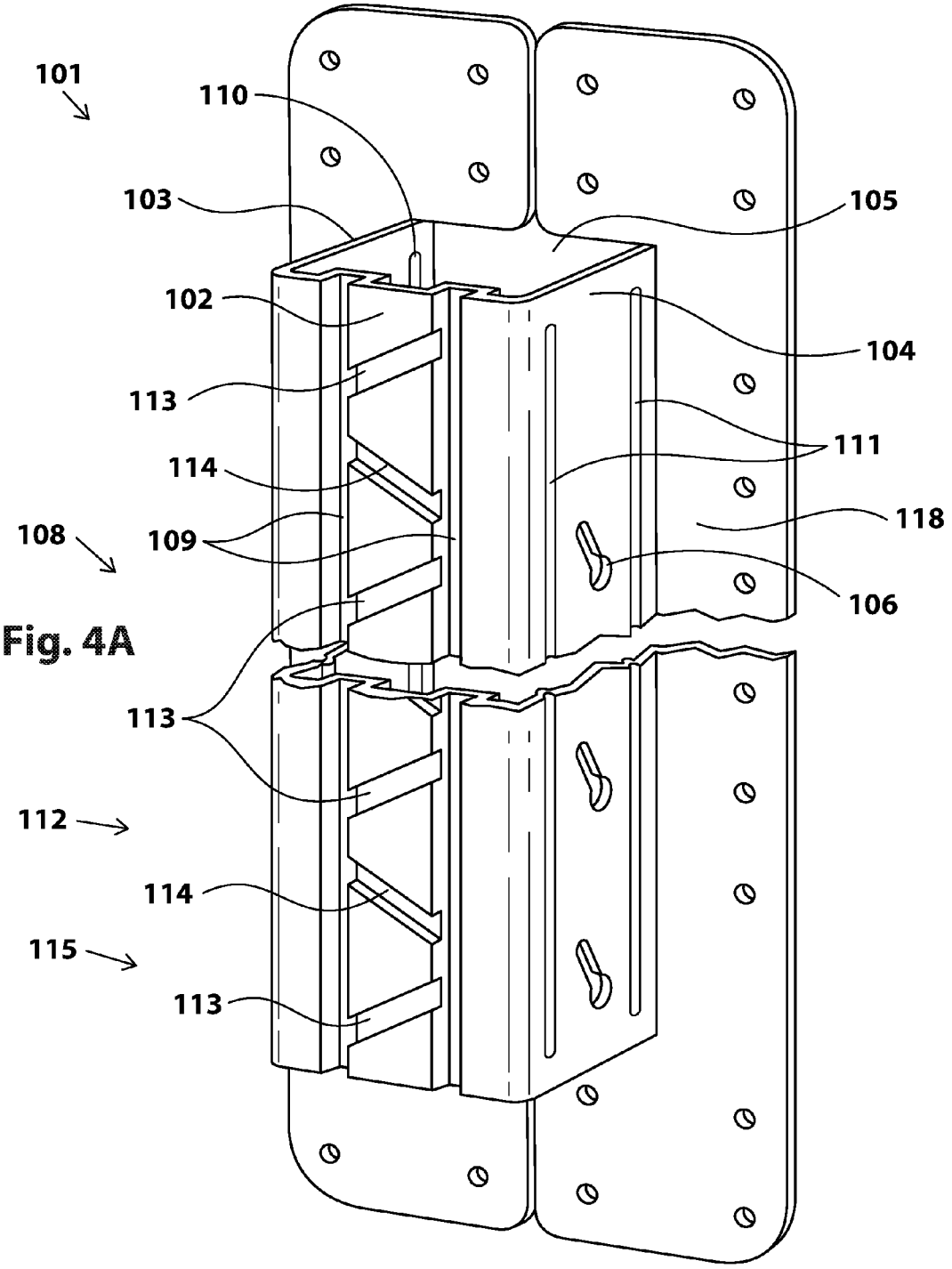
FIGS. 4A, 4B, and 4C illustrate perspective views of the unique continuous-strut-atop-fence-post fence-post-channel-sealing strut-aligning strut-locking foundation-locking flange fence-post systems.
Figure 4B:
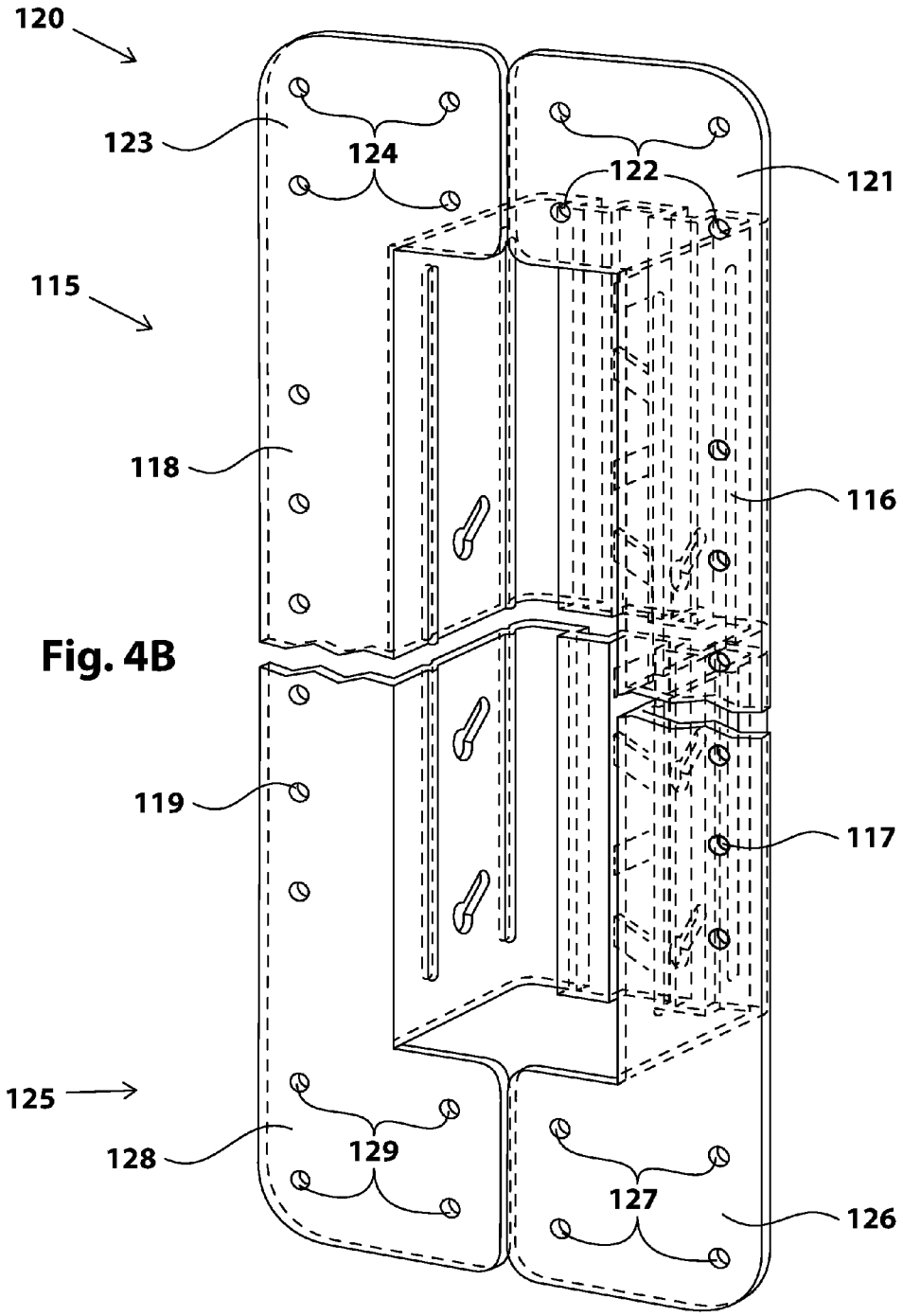
Figure 4C:
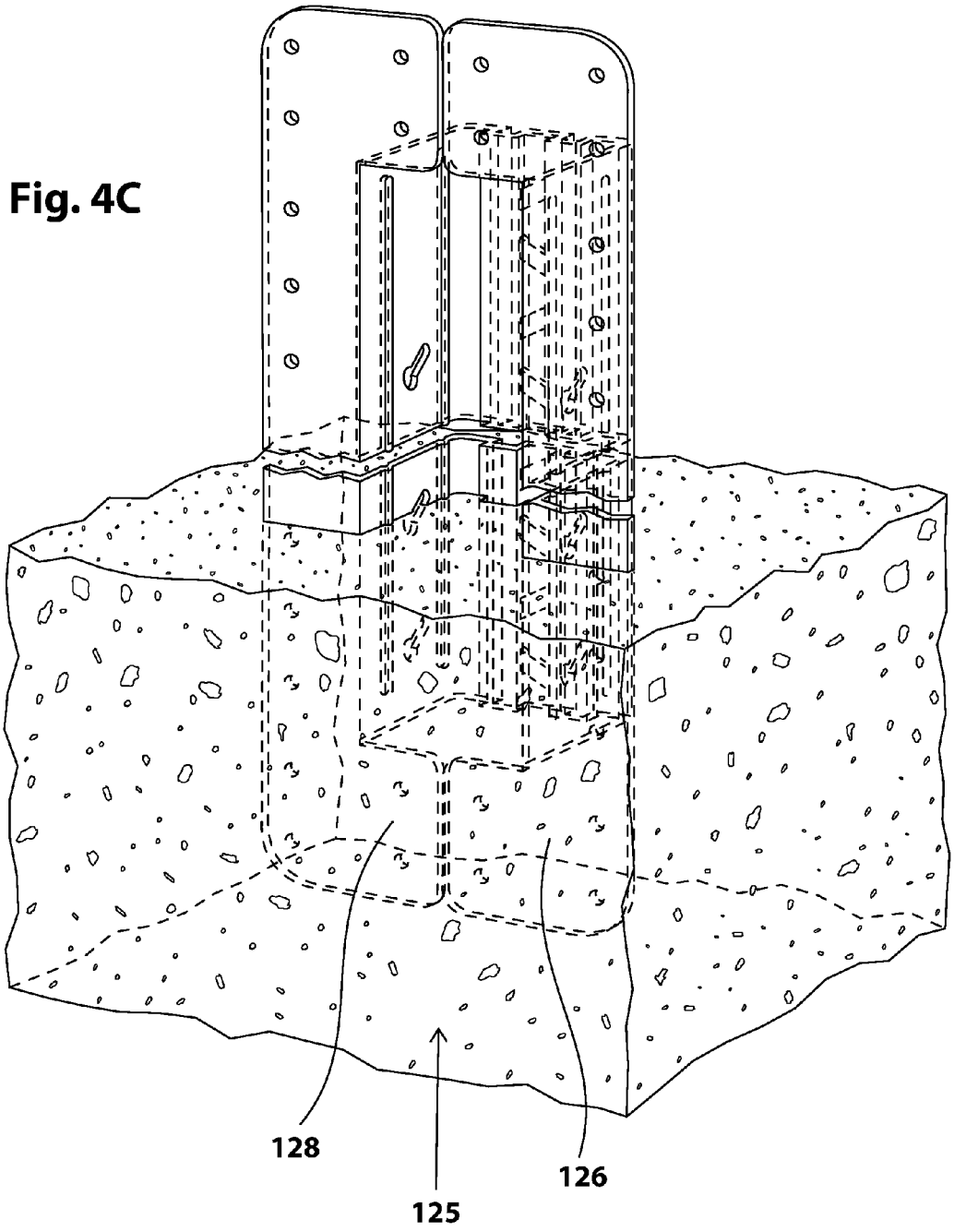

Referring to FIGS. 4A, 4B. 4C, 5, 6A, 6B, 7A, 7B, 7C, 8A, 8B, 8C, and 8D, unique fence post herein is comprised of a central section 102, left-flank and right-flank sections 103 and 104 molded to ends of central section 102 to form a U shape, fence-post channel 105, angled openings 106 punch-pressed in left-flank and right-flank sections 103 and 104, and fence-post screws 107. It further contains an anti-bending-and-anti-warping rib system 108, which is made of anti-bending-and-anti-warping ribs 109, 110, and 111 which are formed on the central section shown in 102.

Further the system is comprised of an anti-torsion rib system 112, which is made of anti-clockwise-torsion ribs 113 and anti-counterclockwise-torsion ribs 114, and a vertical bracket system 115. The vertical bracket system is comprised of a vertical-bracket body 116 molded to the end of the left-flank section 103, vertical-bracket holes 117 drilled into the vertical-bracket body 116, a vertical-bracket body 118 molded to the end of the right-flank section 104, and vertical-bracket holes 119 drilled into the vertical-bracket body 117.

The upper flange system of 120, is comprised of an upper flange body 121 molded to the upper end of the left-flank section 103, upper flange holes 122 drilled in the upper flange body 121, upper flange body 123 molded to the upper end of right-flank section 104, and upper flange holes 124 drilled in upper flange body 123. The upper flange system of 120 is further comprised of a lower flange body 126 molded to the lower end of the left-flank section 103, lower flange holes 127 drilled in the lower flange body 126, the lower flange body 128 molded to the lower end of the right-flank section 104, and lower flange holes 129 drilled into the lower flange body 128.

The L-shaped bracket system 130, is comprised of an L-shaped-bracket body 131, L-shaped-bracket hook 132 molded to the L-shaped-bracket body 131, and an L-shaped-bracket fang 133 molded to the L-shaped-bracket body 131.

The L-shaped bracket system of 134, is comprised of an L-shaped-bracket body 135, L-shaped-bracket hook 136 molded to L-shaped-bracket body 135, and L-shaped-bracket fang 137 molded to the L-shaped-bracket body 135. The L-shaped-bracket bodies 131 and 135 are attached to fence-post system 101 by rotatingly engaging the L-shaped-bracket hooks 132 and 136 into angled openings 106 such that a portion of each of L-shaped-bracket bodies 131 and 135 extend outward respectively, of left-flank and right-flank sections 103 and 104.

The fence system 138, is comprised of upper struts 139 each on a respective fence-post top (of the fence-post system of 101), lower struts 140 each of which is engaged with at least one of the vertical-bracket bodies 116 and 118, and with at least one of the L-shaped-bracket bodies 131 and 135, fence boards 141 screwed on upper struts 139 and lower struts 140, and fence-board screws 142.

To further describe the function of the fence post system, referring to FIGS. 4A, 4B, 4C, 5, 6A, 6B, 7A, 7B, 7C, 8A, 8B, 8C, and 8D. The central section 102 (FIG. 5) provides the following functionalities:

a) Continuously running upper struts 139 on top of central section 102;
b) Continuously sitting upper struts 139 on top of central section 102;
c) Uniquely and effectively allowing one person to easily install the unique continuous-strut-atop-fence-post fence-post-channel-sealing strut-aligning strut-locking foundation-locking flange fence-post systems;
d) Uniquely and effectively supporting the weight of upper struts 139 (by allowing upper struts 139 to run continuously on top of central section 102, and to sit on top of central section 102).

The Left-flank section 103 is for (FIG. 5):

a) Continuously running upper struts 139 on top of left-flank section 103;
b) Continuously sitting upper struts 139 on top of left-flank section 103;
c) Uniquely and effectively allowing one person to easily install the unique continuous-strut-atop-fence-post fence-post-channel-sealing strut-aligning strut-locking foundation-locking flange fence-post systems;
d) Uniquely and effectively supporting the weight of upper struts 139 (by allowing upper struts 139 to run continuously on top of left-flank section 103, and to sit on top of left-flank section 103).

The Right-flank section 104 is for (FIG. 5):

a) Continuously running upper struts 139 on top of right-flank section 104;

b) Continuously sitting upper struts 139 on top of right-flank section 104;

c) Uniquely and effectively allowing one person to easily install the unique continuous-strut-atop-fence-post fence-post-channel-sealing strut-aligning strut-locking foundation-locking flange fence-post systems;

d) Uniquely and effectively supporting the weight of upper struts 139 (by allowing upper struts 139 to run continuously on top of right-flank section 104, and to sit on top of right-flank section 104).

Figure 5:
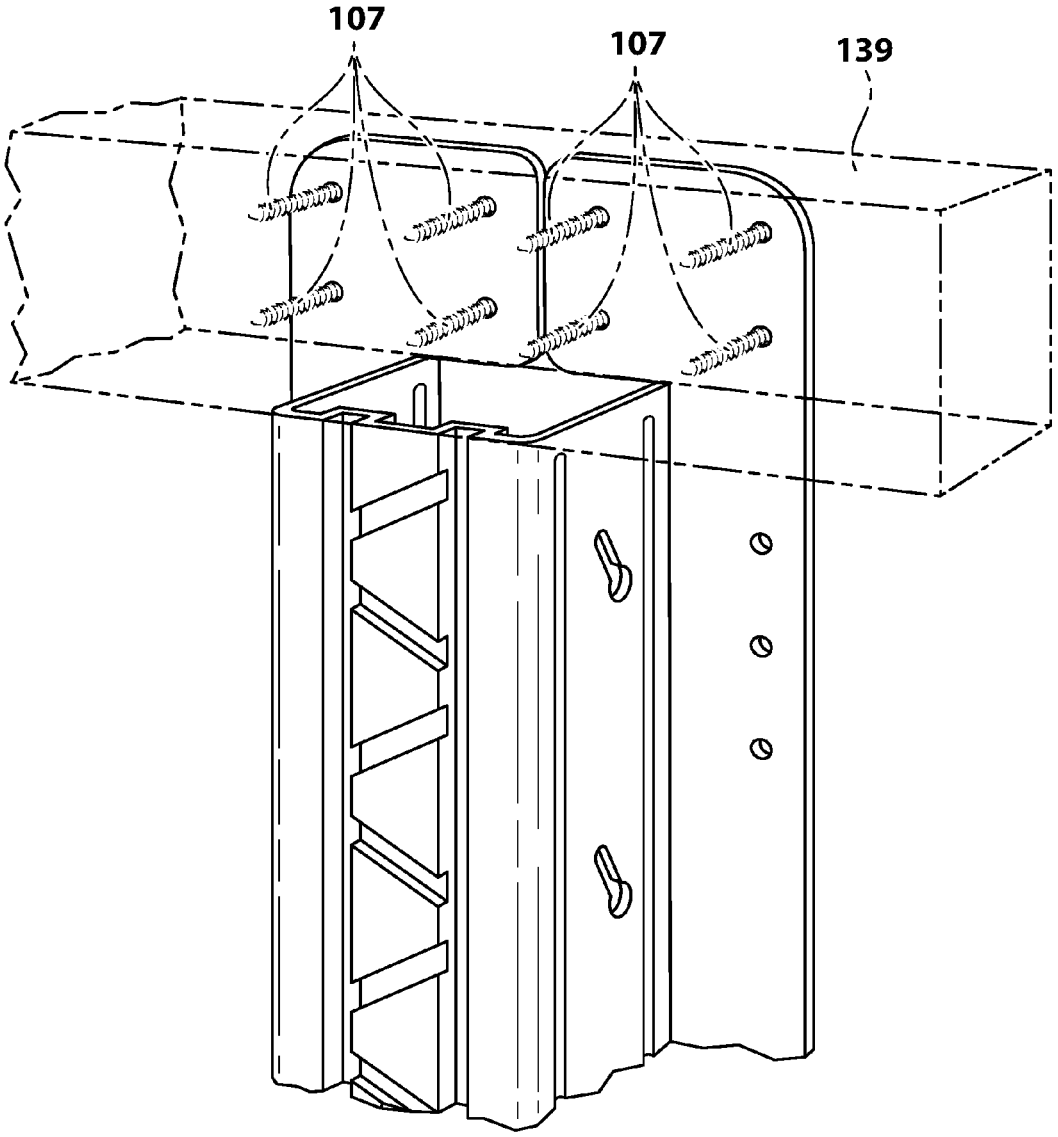
FIG. 5 illustrates a perspective view of how struts continuously run and sit on top of the unique continuous-strut-atop-fence-post fence-post-channel-sealing strut-aligning strut-locking foundation-locking flange fence-post systems.

The Fence-post channel of 105 is for spacing the left-flank section 103 and right-flank section 104 (FIG. 5).

The Angled L-shaped-bracket openings 106 each are for (FIG. 5):

a) Attaching right-side-up L-shaped bracket system 130 to left-flank section 103 or right-flank section 104; and b) Attaching upside-down L-shaped bracket system 134 to left-flank section 103 or right-flank section 104.

The Fence-post screws 107 each are for attaching upper strut 139 or lower strut 140 to fence-post system 101.

The anti-bending-and-anti-warping rib system 108 is for performing combined functions of it components (FIG. 4A), namely stability in the form of preventing bending and warping. It does so by using a central-section of anti-bending-and-anti-warping ribs 109, which each are for:

a) Resisting the bending forces exerted on fence-post system 101;

b) Resisting the warping forces exerted on fence-post system 101; and c) Reinforcing fence-post system 101.

The Left-flank-section anti-bending-and-anti-warping rib 110 is for:

a) Resisting the bending forces exerted on fence-post system 101;

b) Resisting the warping forces exerted on fence-post system 101; and c) Reinforcing fence-post system 101.

The Right-flank-section anti-bending-and-anti-warping rib 111 is for:

a) Resisting the bending forces exerted on fence-post system 101;

b) Resisting the warping forces exerted on fence-post system 101; and c) Reinforcing fence-post system 101.

The anti-clockwise-torsion-and-anti-counterclockwise-torsion rib system 112 is for performing combined functions of it components (FIG. 4A). Namely, the anti-clockwise-torsion ribs 113 each are for:

a) Resisting the clockwise torsion exerted on fence-post system 101; and b) Reinforcing fence-post system 101.

The Anti-counterclockwise-torsion ribs 114 each are for:

a) Resisting the counterclockwise torsion exerted on fence-post system 101; and b) Reinforcing fence-post system 101.

Vertical bracket system 115 is for performing combined functions of it components (FIG. 4A) which are as follows. The left vertical-bracket body 116 is for supporting upper struts 139 and lower struts 140. The left vertical-bracket holes 117 each are for screwing fence-post screws 107 through. The right vertical-bracket body 118 is for supporting upper struts 139 and lower struts 140. And the right vertical-bracket holes 119 each are for screwing fence-post screws 107 through.

The Upper strut-aligning strut-locking foundation-locking flange system 120 is for performing combined functions of it components (FIGS. 4A, 4B, 4C, and 5). The upper left strut-aligning foundation-locking flange body 121 is for:

a) Automatically aligning upper struts 139 in at least one straight shape;

b) Automatically aligning upper struts 139 in at least one angled shape;

c) Automatically aligning upper struts 139 in at least one T shape;

d) Automatically aligning upper struts 139 in at least one X shape;

The upper left strut-aligning strut-locking flange holes 122 each are for screwing fence-post screws 107 through.

The upper right strut-aligning foundation-locking flange body 123 is for:

a) Automatically aligning upper struts 139 in at least one straight shape;

b) Automatically aligning upper struts 139 in at least one angled shape;

c) Automatically aligning upper struts 139 in at least one T shape;

d) Automatically aligning upper struts 139 in at least one X shape.

The upper right strut-aligning strut-locking flange holes 124 each are for screwing fence-post screws 107 through.

The lower strut-aligning strut-locking foundation-locking flange system 125 is for performing combined functions of it components (FIGS. 4A, 4B, 4C, and 5). Namely, the lower left strut-aligning foundation-locking flange body 126 is for:

a) Automatically aligning upper struts 139 in at least one straight shape;

b) Automatically aligning upper struts 139 in at least one angled shape;

c) Automatically aligning upper struts 139 in at least one T shape;

d) Automatically aligning upper struts 139 in at least one X shape.

The lower left strut-aligning strut-locking flange holes 127 each are for screwing the fence-post screw 107 through.

The lower right strut-aligning foundation-locking flange body 128 is for:

a) Automatically aligning upper struts 139 in at least one straight shape;

b) Automatically aligning upper struts 139 in at least one angled shape;

c) Automatically aligning upper struts 139 in at least one T shape;

d) Automatically aligning upper struts 139 in at least one X shape.

The lower right strut-aligning strut-locking flange holes 129 each are for screwing the fence-post screws 107 through.

Figure 6A:
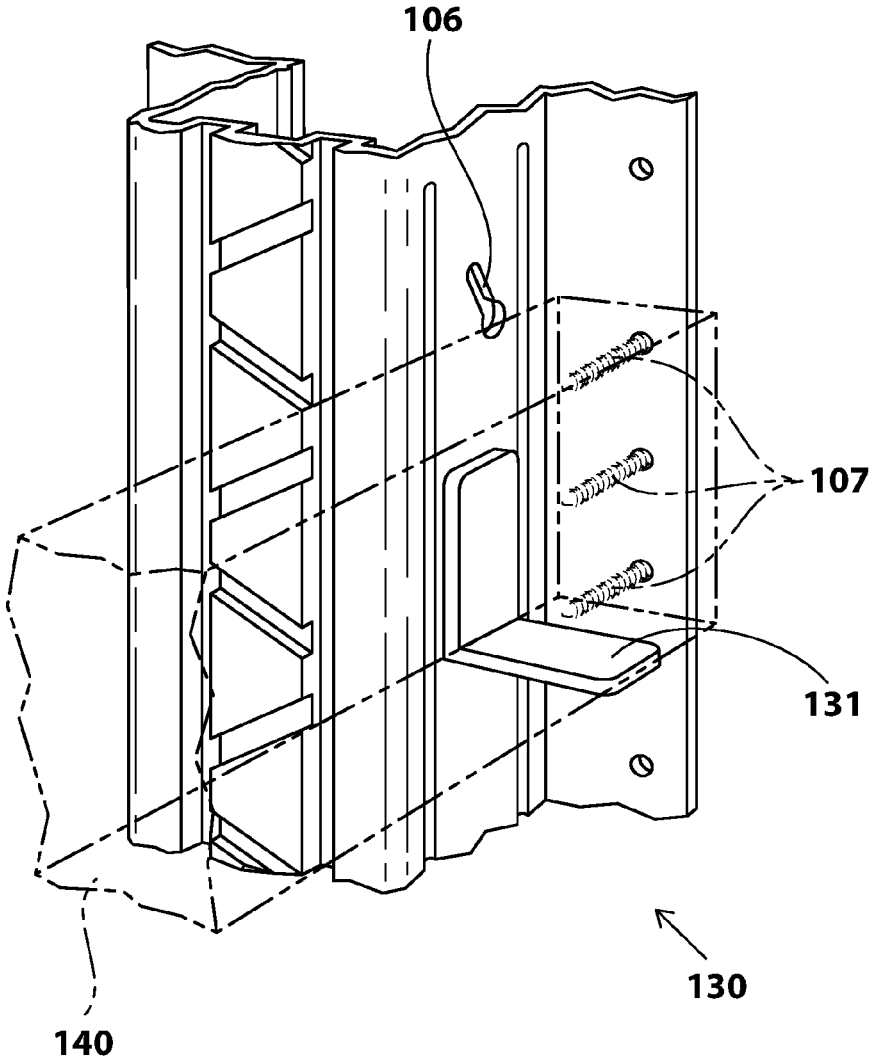
FIGS. 6A and 6B illustrate perspective views of how struts sit on top of the right-side-up L-shaped bracket system and the upside-down L-shaped bracket system.
Figure 6B:
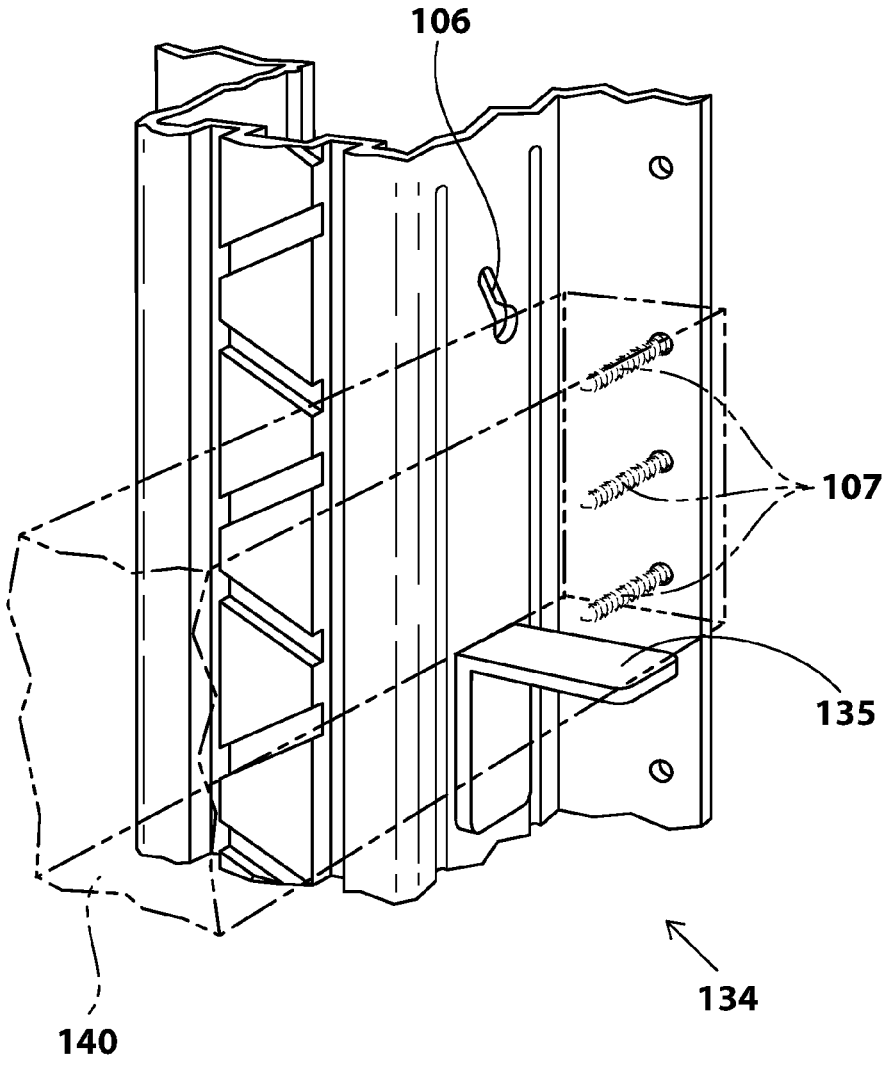
Figure 7A:
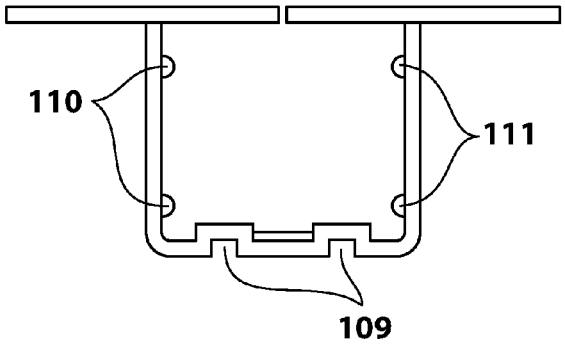
FIGS. 7A, 7B, and 7C illustrate top, rear, and side views of the unique continuous-strut-atop-fence-post fence-post-channel-sealing strut-aligning strut-locking foundation-locking flange fence-post systems.
Figure 7B:
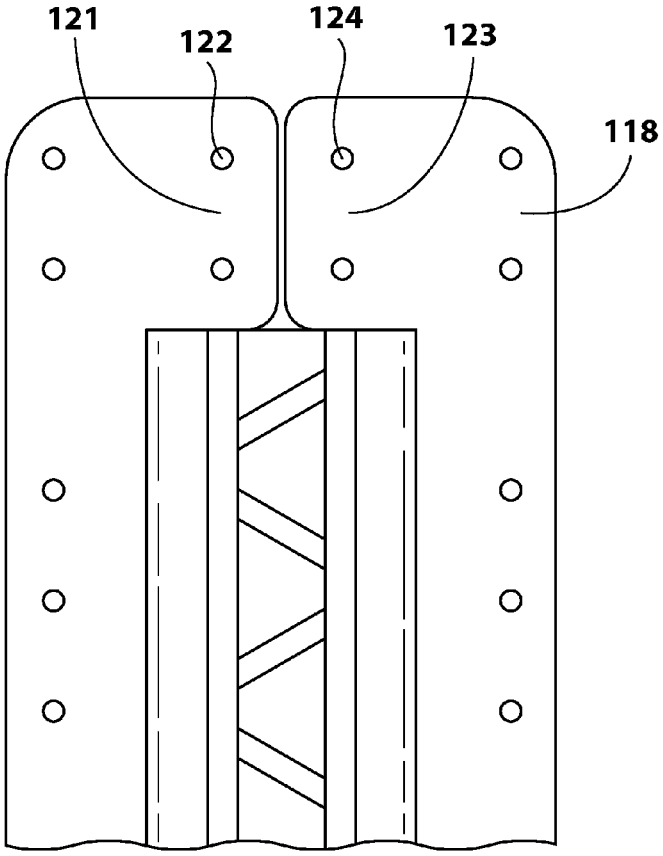
Figure 7C:
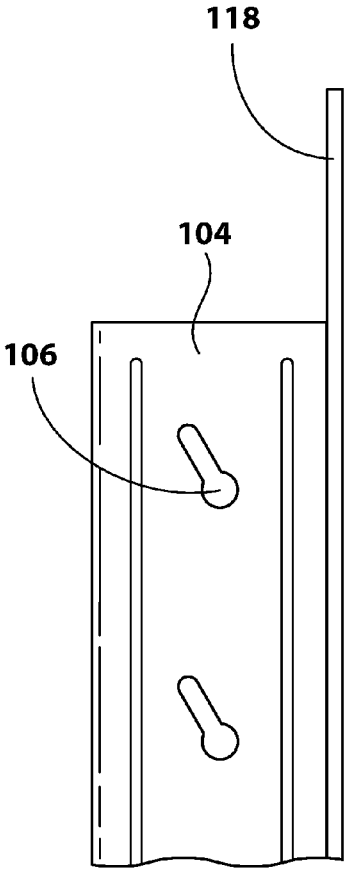
Figure 8A:
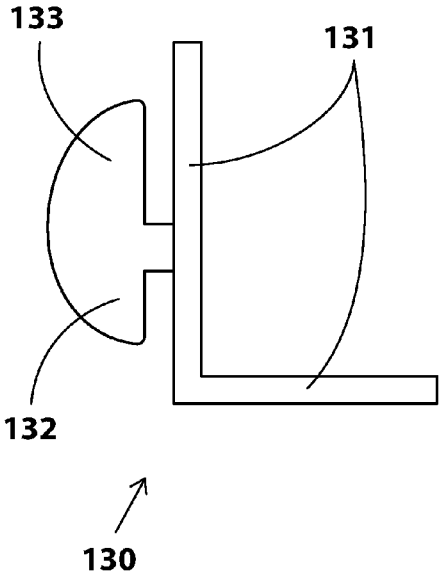
FIGS. 8A, 8B, 8C, and 8D illustrate side, front, and top views of the right-side-up L-shaped bracket system and the upside-down L-shaped bracket system.
Figure 8B:
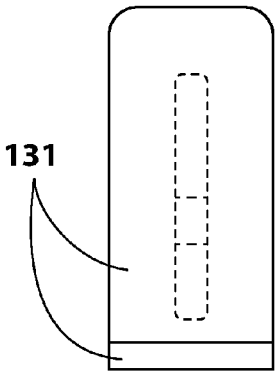
Figure 8C:
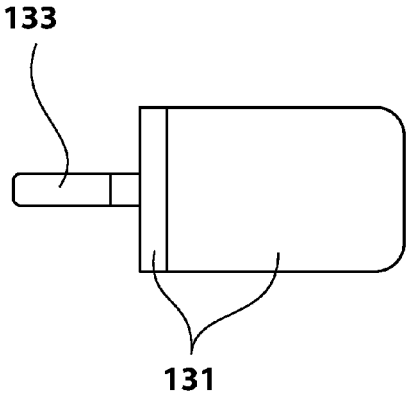
Figure 8D:
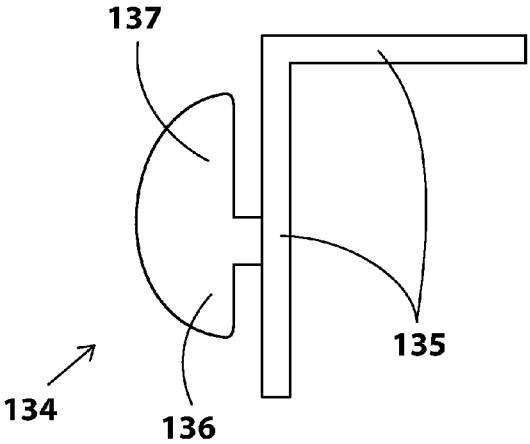
Figure 9A:
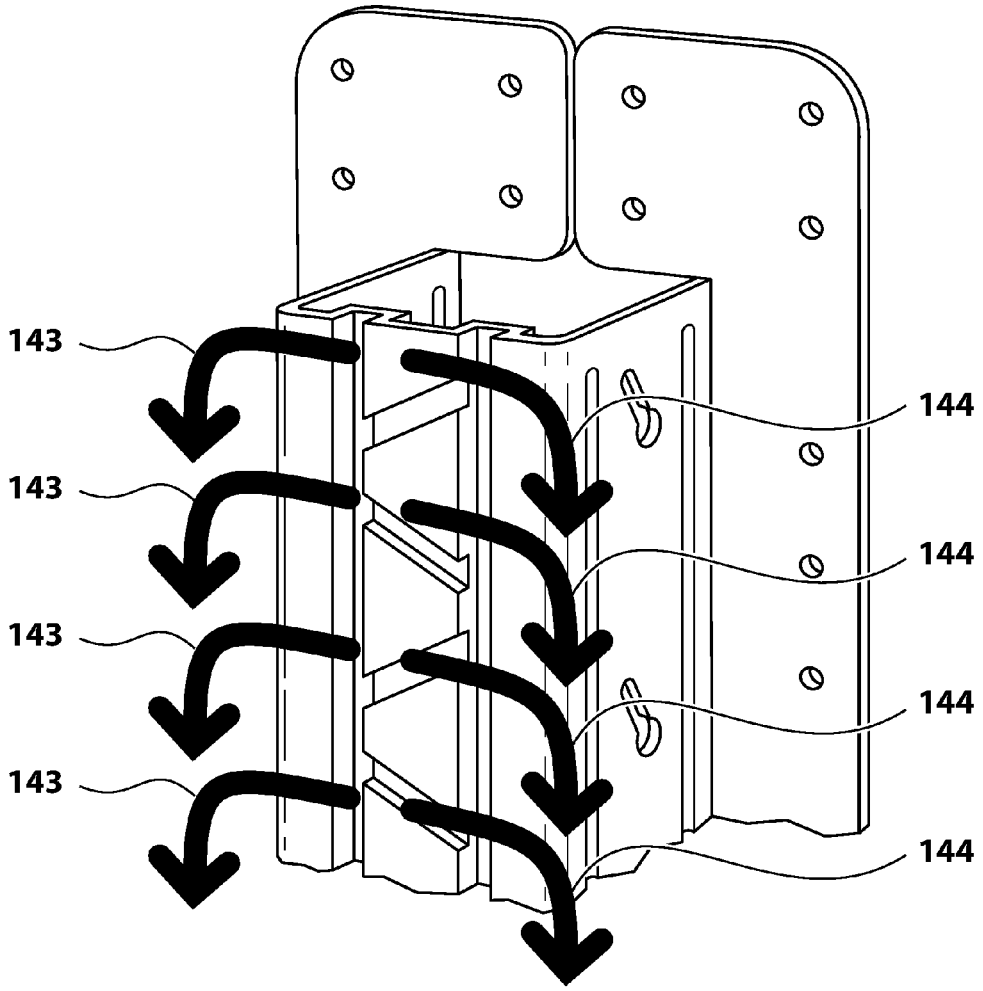
FIGS. 9A and 9B illustrate perspective views of central-section anti-bending-and-anti-warping ribs, left-flank-section anti-bending-and-anti-warping ribs, and right-flank-section anti-bending-and-anti-warping ribs.
Figure 9B:
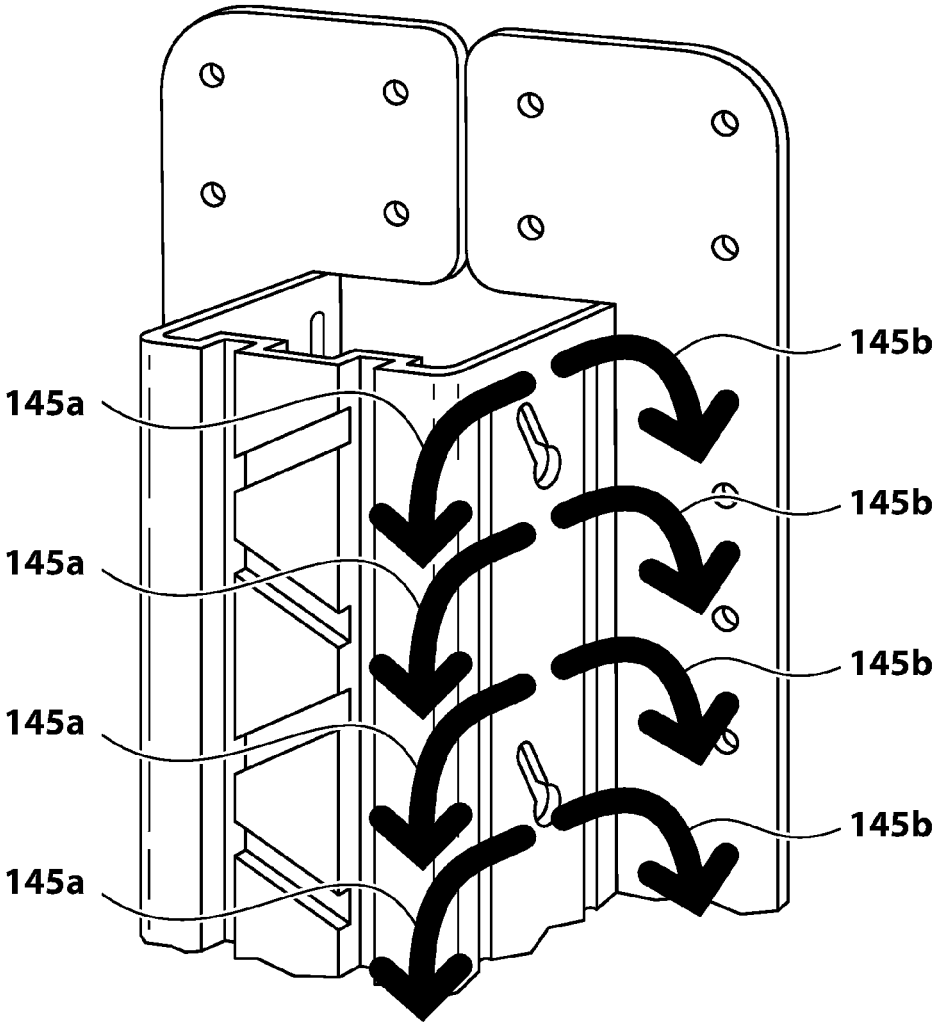
Figure 9C:
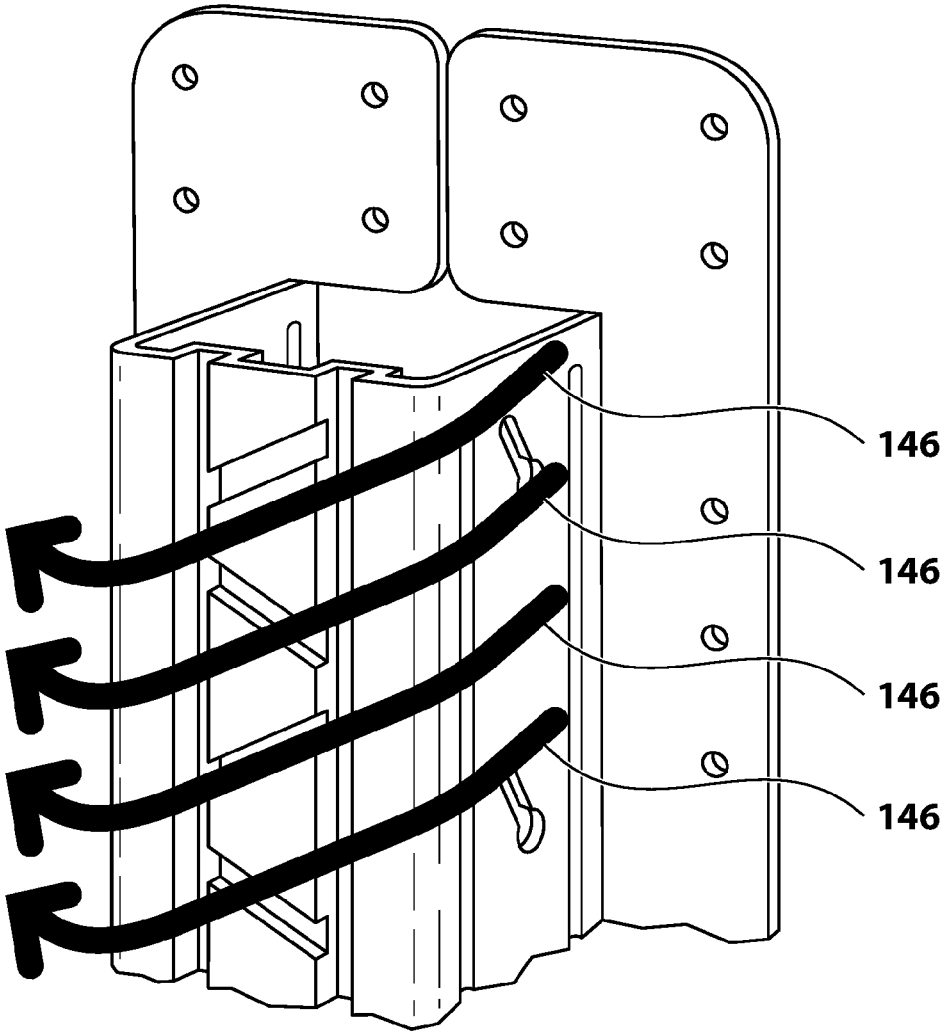
FIGS. 9C and 9D illustrate perspective views of anti-clockwise-torsion ribs and anti-counterclockwise-torsion ribs.
Figure 9D:
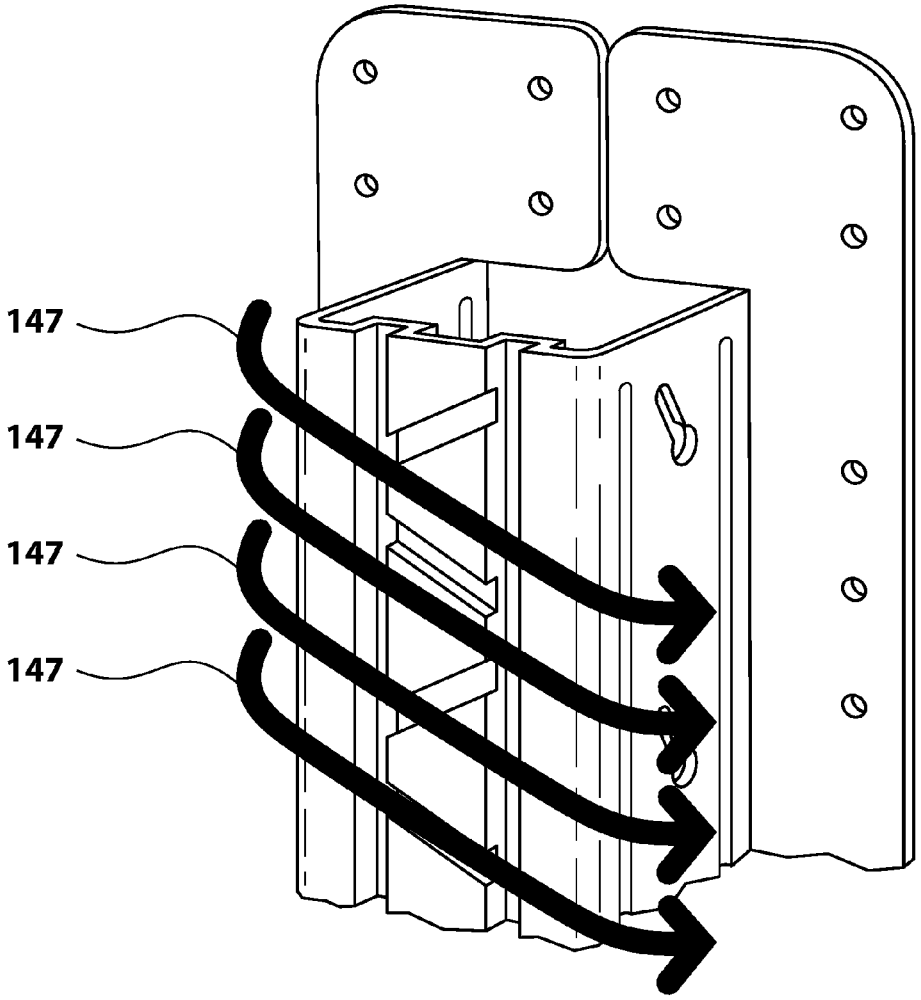
Figure 10A:
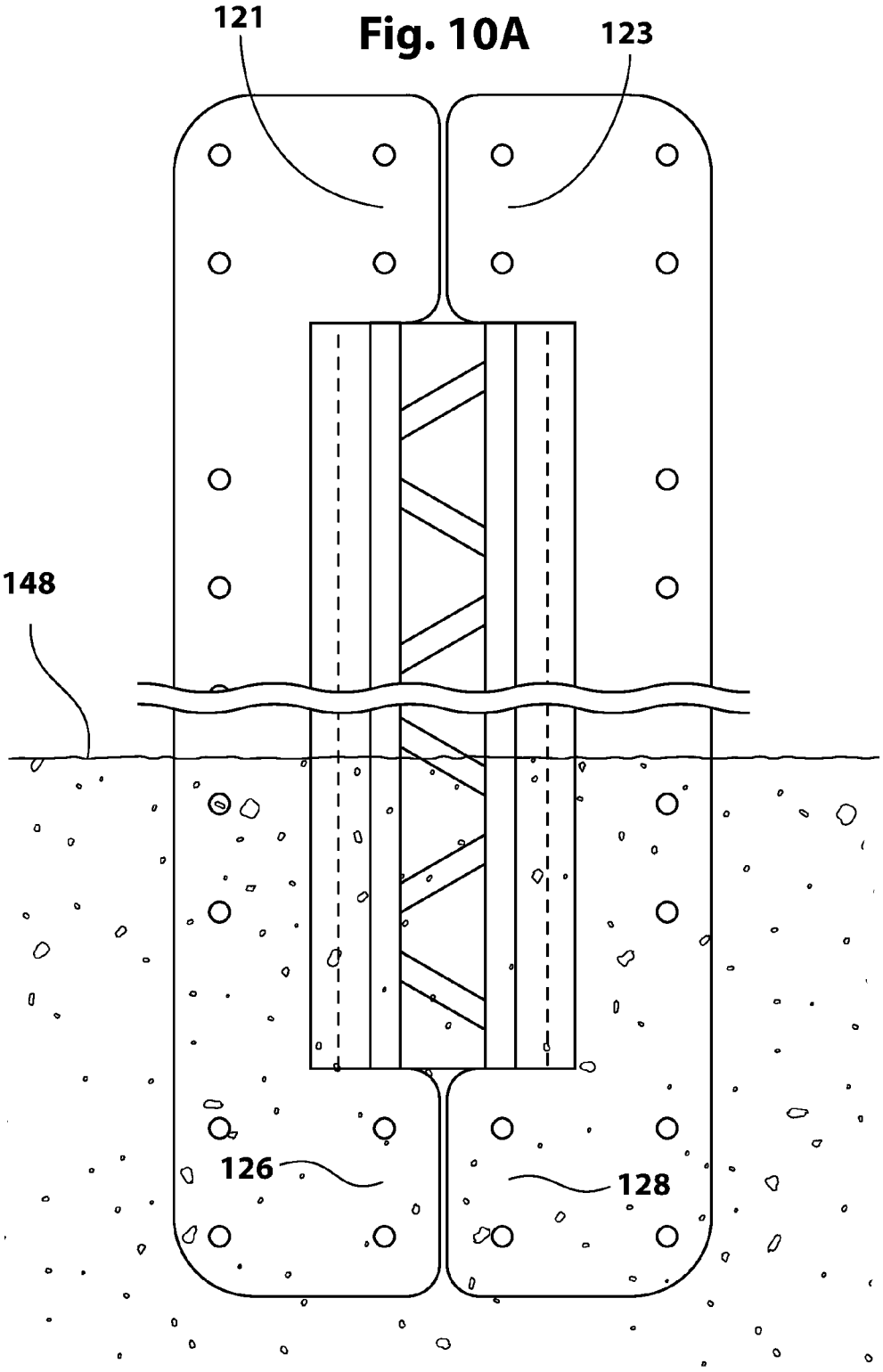
FIGS. 10A, 10B, 10C, and 10D illustrate front and top views of how to run and sit the upper struts on top of the unique fence-post systems.
Figure 10B:
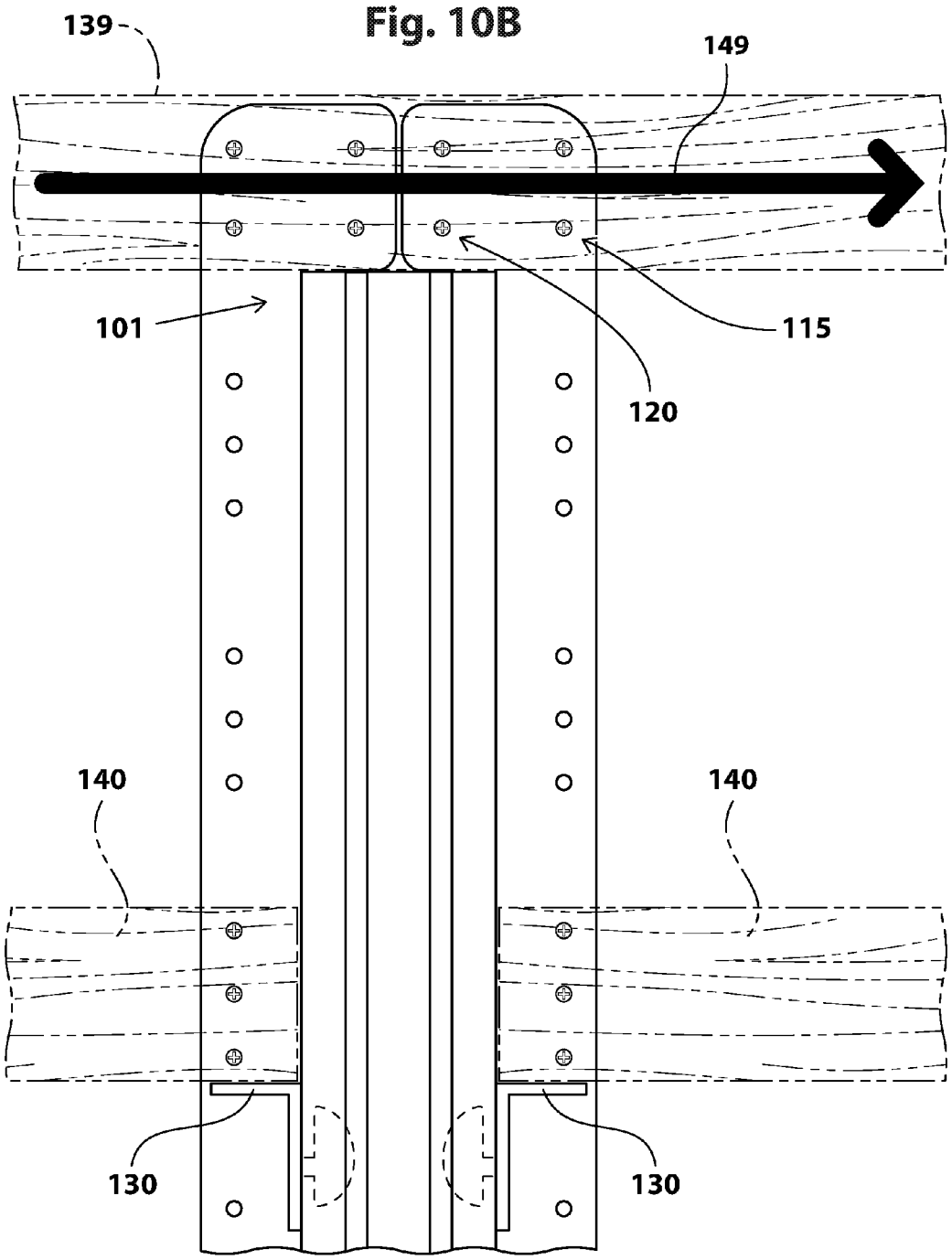
Figure 10C:
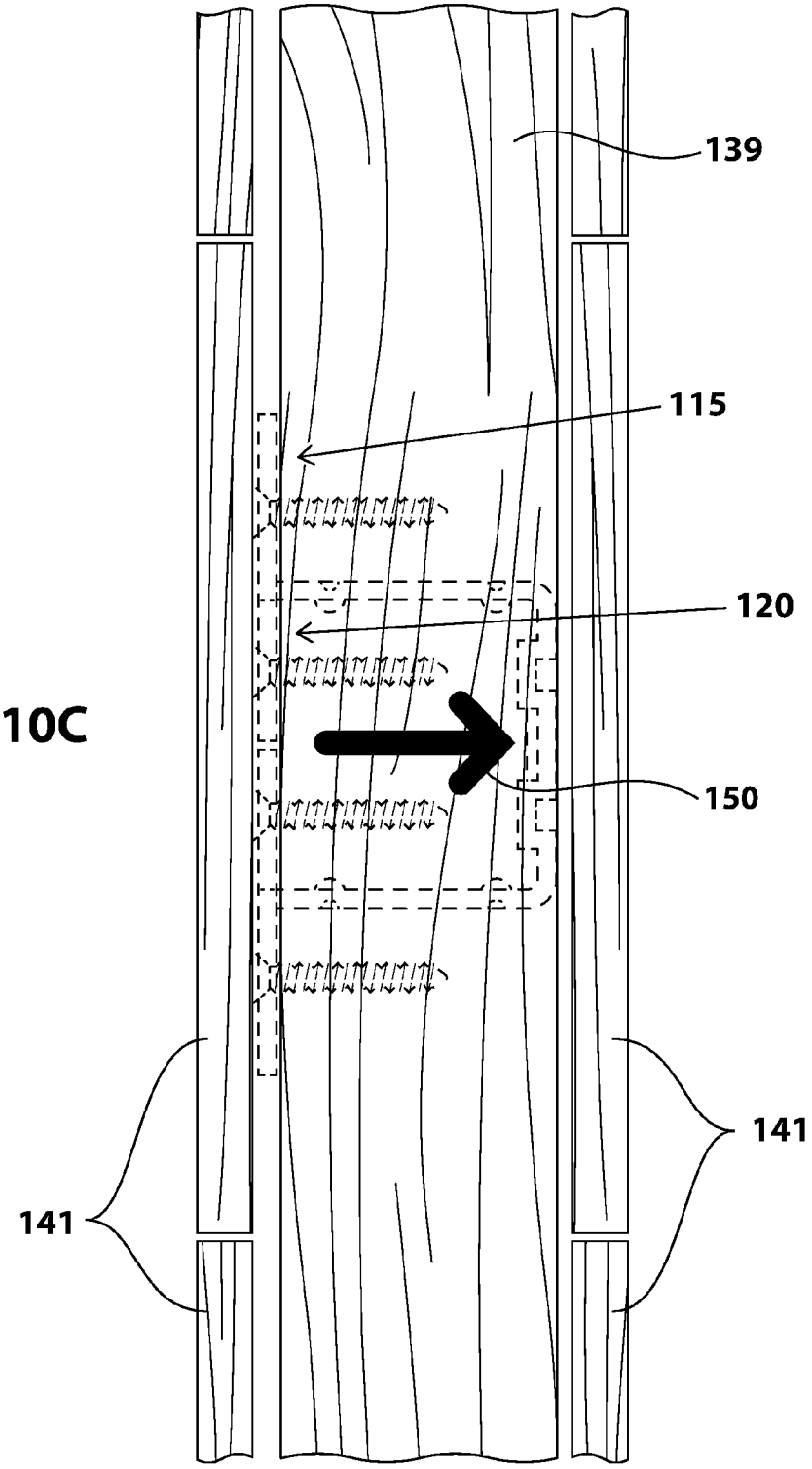
Figure 10D:
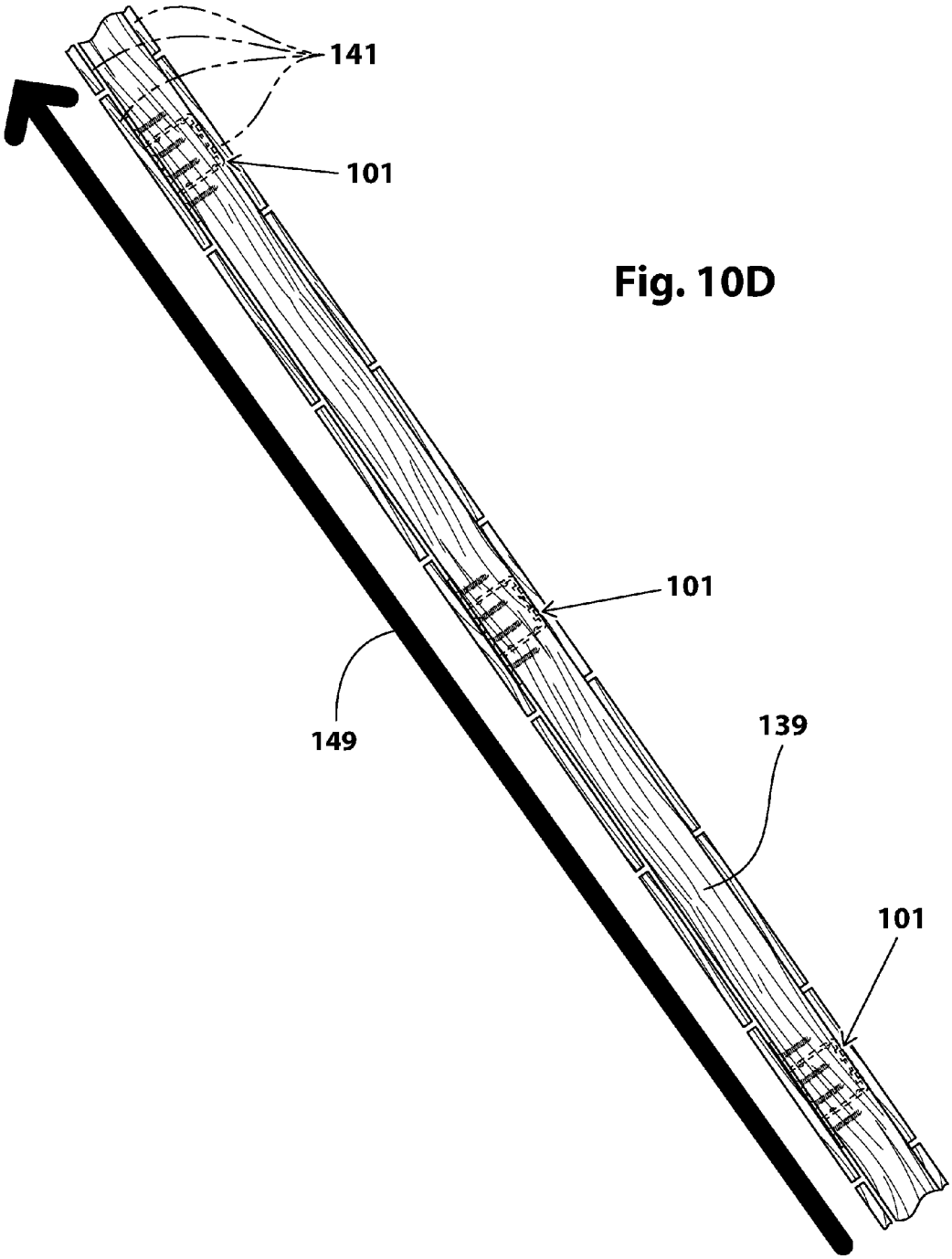
Figure 11A:
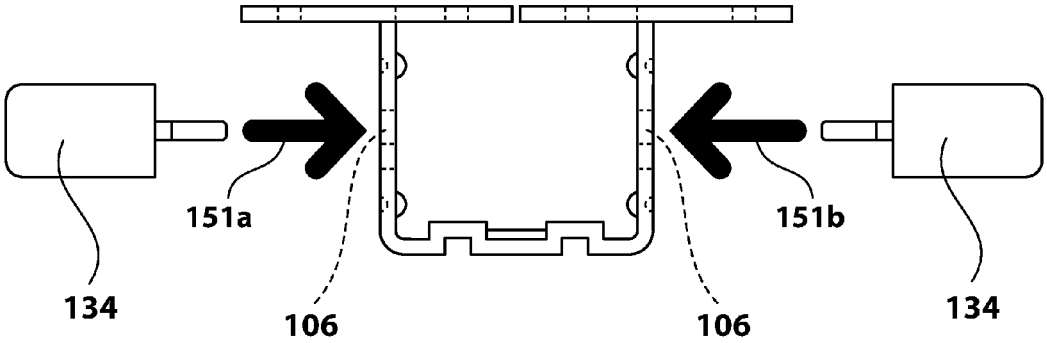
FIGS. 11A, 11B, 11C, 11D, and 11E illustrate top, rear, and side views of how to install the right-side-up L-shaped bracket system and the upside-down L-shaped bracket system.
Figure 11B:
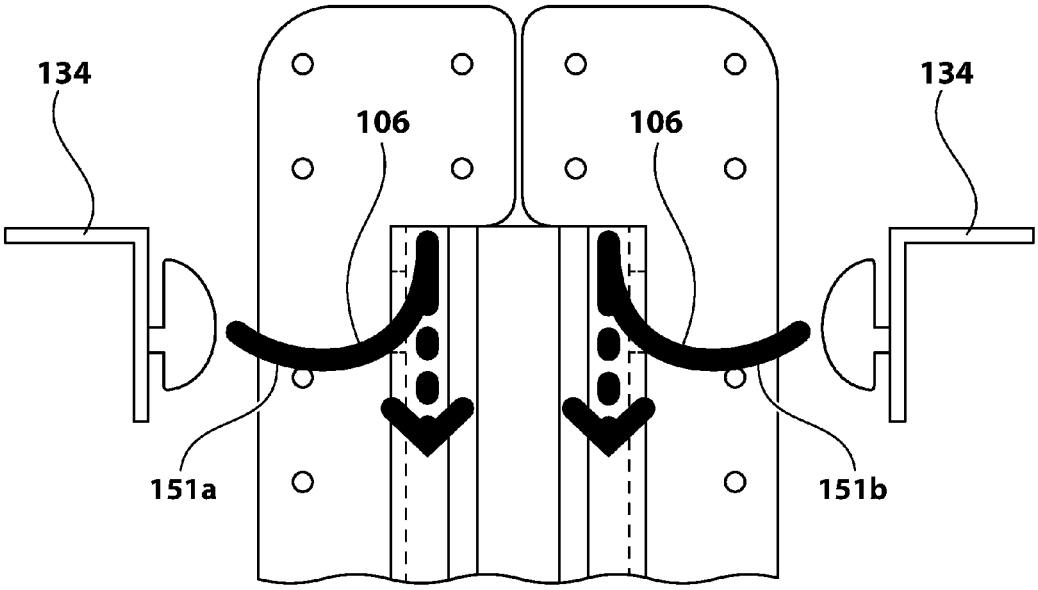
Figure 11C:
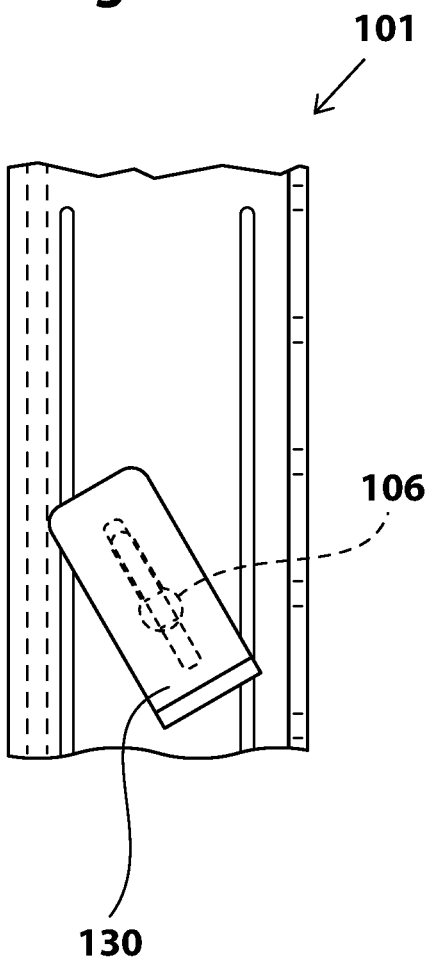
Figure 11D:
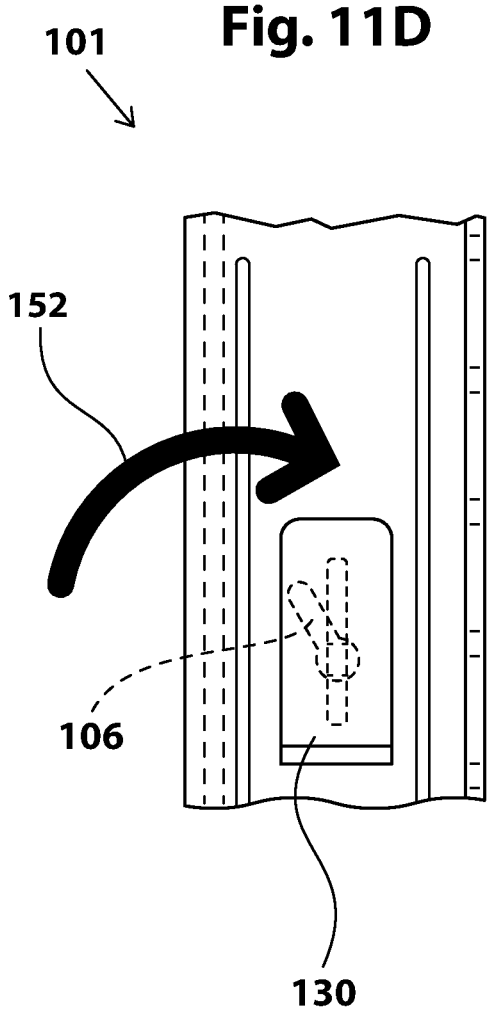
Figure 11E:
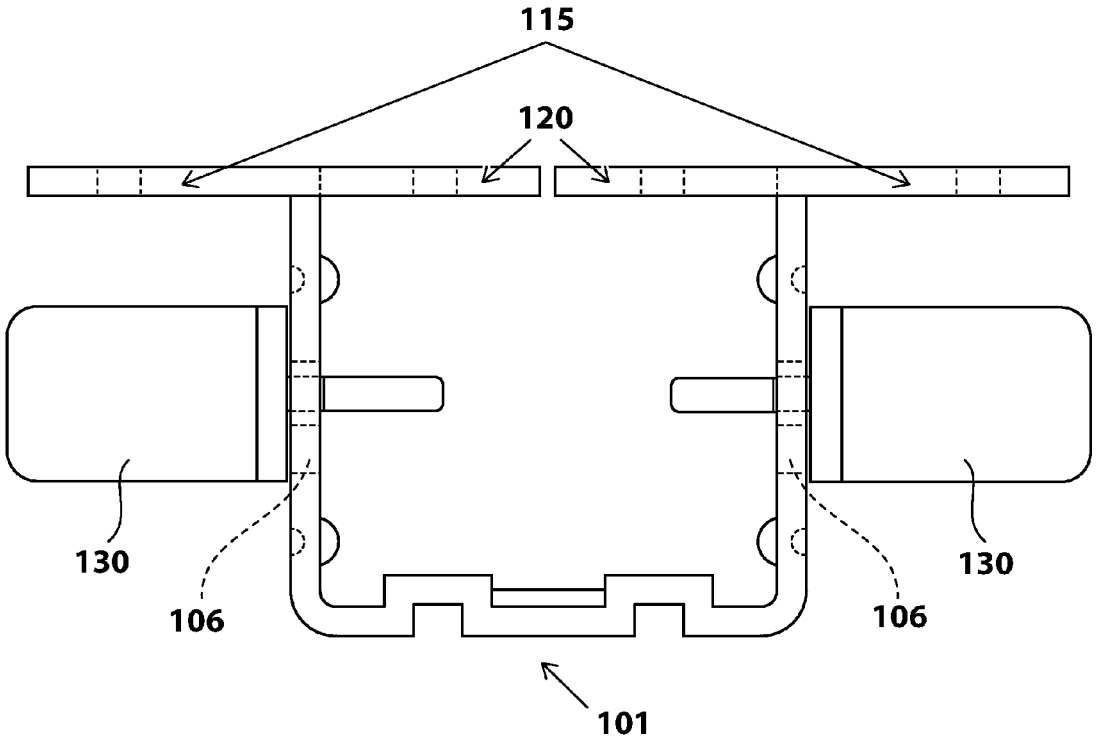

The right-side-up L-shaped bracket system 130 is for performing combined functions of it components (FIGS. 6A and 6B). Namely, the right-side-up L-shaped-bracket body 131 is for supporting upper struts 139 or lower struts 140. The right-side-up L-shaped-bracket hook 132 is for hooking into angled L-shaped-bracket openings 106. And the right-side-up L-shaped-bracket fang 133 is for locking the right-side-up L-shaped bracket system 130 onto fence-post system 101.

The upside-down L-shaped bracket system 134 is for performing combined functions of it components (FIGS. 6A and 6B). Namely, the upside-down L-shaped-bracket body 135 is for supporting the upper struts 139 or lower struts 140. The upside-down L-shaped-bracket hook 136 is for hooking into the angled L-shaped-bracket openings 106. And the upside-down L-shaped-bracket fang 137 is for locking the upside-down L-shaped bracket system 134 onto the fence-post system 101.

The fence-strut-and-fence-board system 138 is for performing combined functions of it components (FIGS. 5, 6A, and 6B). Namely, the upper struts 139 each are for (FIG. 5):

a) Continuously running on top of central section 102;
b) Continuously running on top of left-flank section 103;
c) Continuously running on top of right-flank section 104;
d) Continuously sitting on top of central section 102.

The lower struts 140 each are for (FIGS. 6A and 6B):

a) Sitting on top of right-side-up L-shaped bracket system 130; or
b) Sitting on top of upside-down L-shaped bracket system 134.

And finally, the fence boards 141 each are for creating a barrier, while the fence-board screws 142 each are for screwing the fence board 141 to the upper strut 139 or the lower strut 140.

Regarding the operation of the invention herein, the fence posts have the unique capability of continuously running and sitting struts on top of fence posts, of covering and sealing fence-post channels, providing for an anti-bending-and-anti-warping rib system, an anti-clockwise-torsion-and-anti-counterclockwise-torsion rib system, as well as an upper strut-aligning and strut-locking flange system with a foundation-locking flange system feature, as well as a lower strut-aligning and strut-locking flange system with a foundation-locking flange system functionality.

Now referring to FIGS. 9A, 9B, 9C, 9D, 10A, 10B, 10C, 10D, 11A, 11B, 11C, 11D, and 11E, to further describe the operation of the unique fence post system described herein, the system may be architecturally double-powder-coated for high performance. This may be carried out by the following steps: Powder-coating all the components of the fence post system with a base coat;

Gelling the base coat; Powder-coating all the components of the fence post system with a top coat; and Curing all the components (architecturally double-powder-coated with the base coat, the gel, and the top coat thereon for high performance) in an oven. This helps to improve heavy-duty adhesion between the base coat, the gel, and the top coat, improve heavy-duty corrosion protection, improve heavy-duty weather resistance, improve heavy-duty scratch resistance, provide for better heavy-duty chemical resistance, impart more depth for 3D like effects, and to improve the heavy-duty service lifespan of all the components.

Further advantages of the invention herein are the capacities to resist bending forces, warping forces, clockwise torsion, and counterclockwise torsion, as well as to reinforce the fence posts at the same time. Reference to the following figures helps to elucidate the mechanisms of how this is provided for with the invention herein.

(FIGS. 9A and 9B) Anti-bending-and-anti-warping ribs 109, anti-bending-and-anti-warping ribs 110, and anti-bending-and-anti-warping ribs 111 are formed onto the fence-post systems 101 in order to resist the bending forces exerted on the fence-post systems 101 (in the directions of arrows 143 and 144), to resist the warping forces exerted on fence-post systems 101 (in the directions of arrows 145*a* and 145*b*), and to reinforce the fence-post system 101 overall.

(FIG. 9C) Anti-clockwise-torsion ribs 113 are formed onto the fence-post systems 101 to resist the clockwise torsion exerted on fence-post system 101, in the directions of arrows 146, and to reinforce fence-post system 101.

(FIG. 9D) Anti-counterclockwise-torsion ribs 114 are formed onto the fence-post systems 101 to resist the counterclockwise torsion exerted on fence-post system 101, in the direction of arrow 147, and to reinforce fence-post system 101.

The invention herein further allows for continuously running and sitting the upper struts on top of fence posts (to eliminate the need for cutting all the upper struts to fit all the spaces between fence-posts, respectively). This is accomplished by the following steps and shown in the following referenced figures.

1) (FIG. 10A) Burying fence-post systems 101 in desired locations in a foundation 148 to lock lower strut-aligning strut-locking foundation-locking flange system 125 inside foundation 148, and to lock fence-post system 101 inside foundation 148 (by using the lower flange system 125); 2) (FIGS. 10B, 10C, and 10D) Continuously running and sitting upper struts 139 on top of fence-post systems 101 against upper flange system 120, respectively, in the direction of the arrows 149. This allows one to continuously run upper struts 139 on top of fence-post systems 101, to continuously sit the upper struts 139 on top of the fence-post systems 101, to uniquely and effectively allow one person to easily install the system, to uniquely and effectively support the weight of upper struts 139, to uniquely and effectively support the weight of fence system 138, to uniquely and effectively support the weight of the fence post system, to eliminate the need for two persons or more to install the system, to eliminate the needs for cutting upper struts 139 to the right lengths between the fence-post systems 101, to eliminate personal injuries (by allowing upper struts 139 to continuously run and sit on top of fence-post systems 101, eliminating the needs for cutting upper struts 139 to the correct lengths between fence-post systems 101), to reduce the time needed for installing the unique continuous-strut-atop-fence-post fence-post-channel-sealing strut-aligning strut-locking foundation-locking flange fence-post systems (by allowing upper struts 139 to continuously run and sit on top of fence-post systems 101), to reduce the labor needed for installing the unique continuous-strut-atop-fence-post fence-post-channel-sealing strut-aligning strut-locking foundation-locking flange fence-post systems (by allowing upper struts 139 to continuously run and sit on top of fence-post systems 101), to automatically aligning upper struts 139 in at least one straight shape, to automatically aligning upper struts 139 in at least one angled shape, to automatically aligning upper struts 139 in at least one T shape, and/or to automatically align the upper struts 139 in at least one X shape. 3) (FIGS. 10B, 10C, and 10D) Screwing the upper struts 139 onto the vertical bracket systems 115 and upper flange systems 120, in the direction of the arrow 150: To lock upper struts 139 in at least one straight shape, to lock upper struts 139 in at least one angled shape, to lock upper struts 139 in at least one T shape, and/or to lock upper struts 139 in at least one X shape.

Further steps include uniquely installing the L-Shaped Brackets. 4) (FIGS. 11A and 11B) At an angle, hooking the L-shaped bracket systems 130 or the L-shaped bracket systems 134 into the angled openings 106, respectively, in the directions of arrows 151*a* and 151*b*; and 5) (FIGS. 11C, 11D, and 11E) rotating L-shaped bracket systems 130 or the L-shaped bracket systems 134, to level and lock them in place, respectively, in the direction of arrow 152;

Installing the Lower Struts and Fence Boards then Comprises the Following Steps.

6) (FIG. 10B) Sitting the lower struts 140 on the L-shaped bracket systems 130 or the L-shaped bracket systems 134. 7) Screwing the lower struts 140 onto the vertical bracket systems 115, the L-shaped bracket systems 130, and/or the L-shaped bracket systems 134, in order to lock the lower struts 139 in at least one straight shape, lock lower struts 139 in at least one angled shape, to lock the lower struts 139 in at least one T shape, and/or to lock lower struts 139 in at least one X shape. And finally, step 8) Screwing the fence boards 141 onto the upper struts 139 and lower struts 140.

Figure 12:
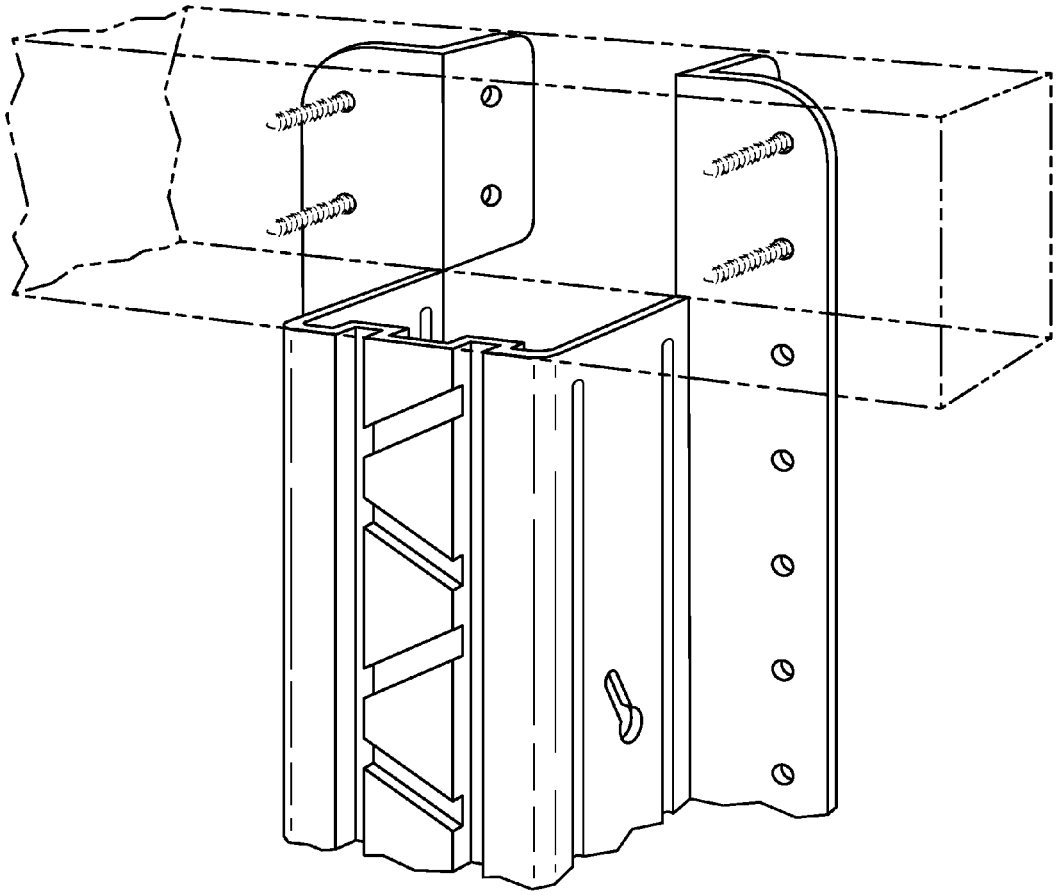
FIGS. 12, 13, and 14 illustrate perspective views of equivalent variations of the fence-post system, with upper struts continuously running and sitting thereon in a straight shape, angled shape, T shape, or an X shape (in one, two, three, or four ways, respectively).
Figure 13:
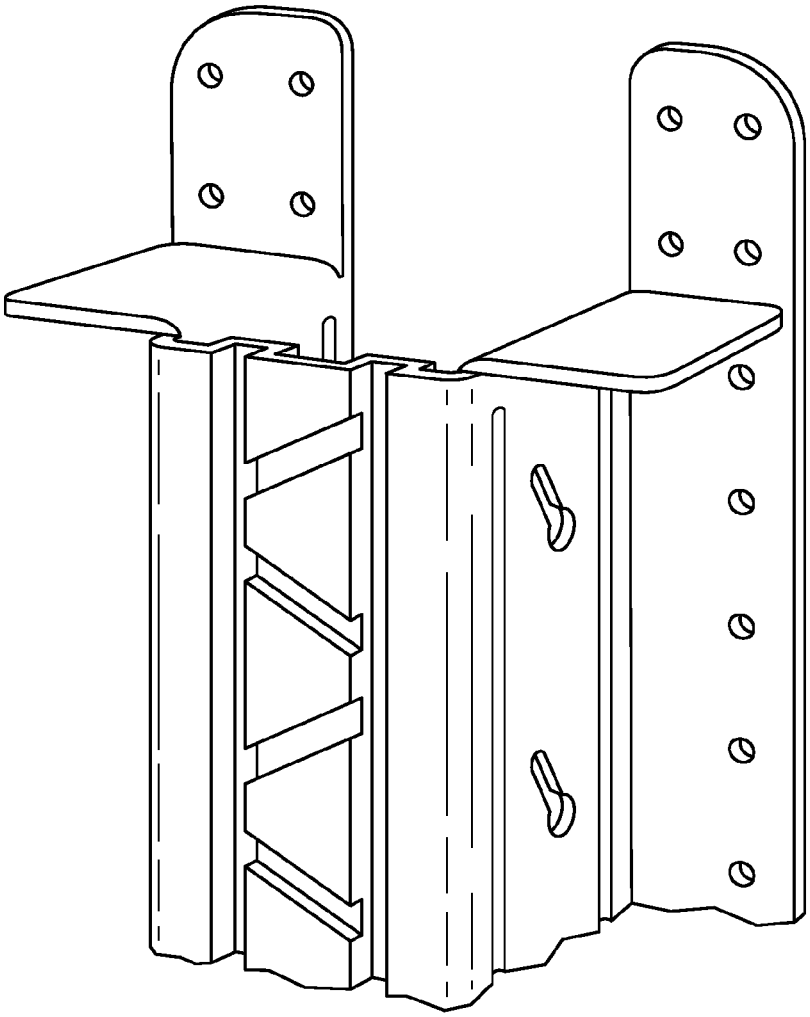
Figure 14:
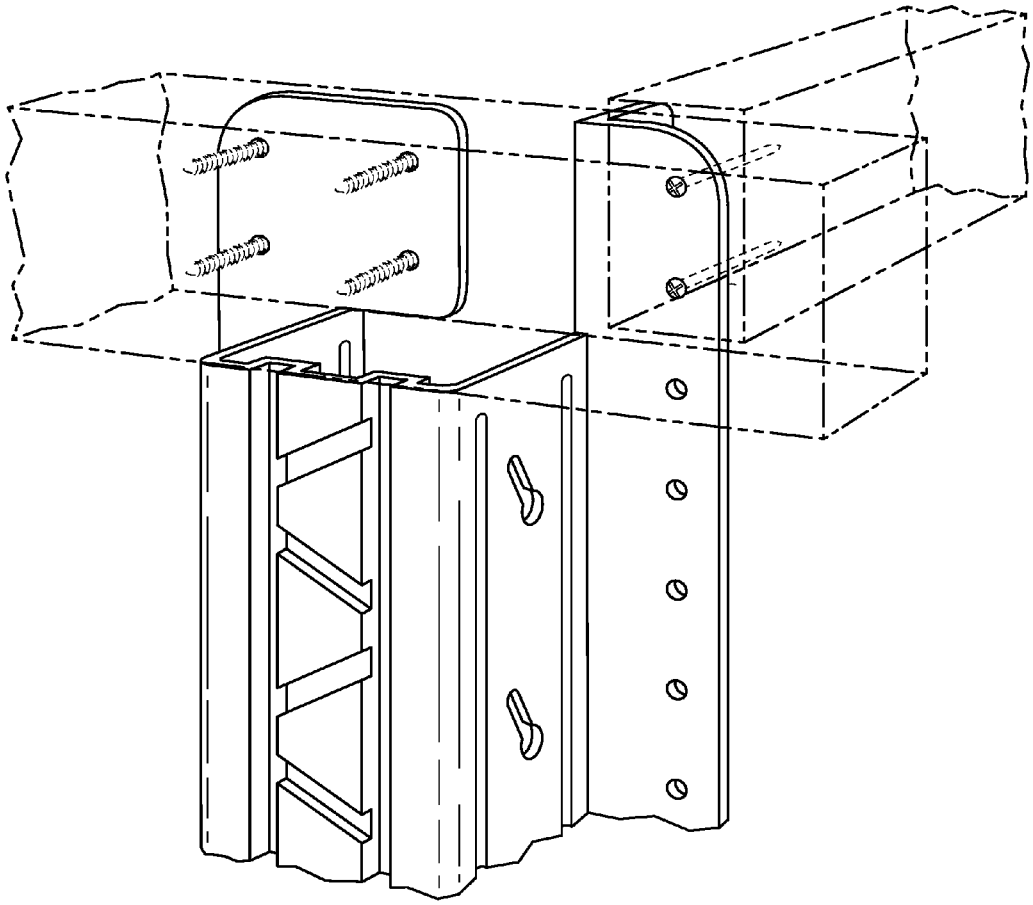
Figure 15A:
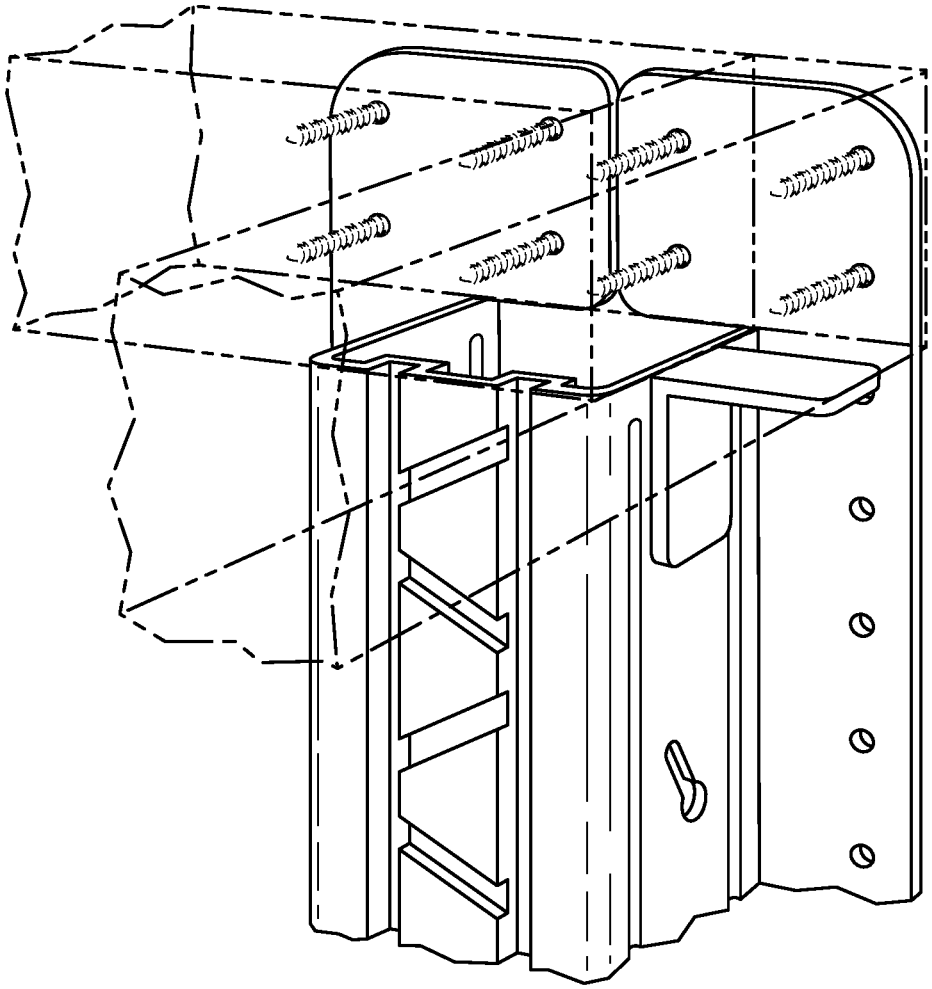
FIGS. 15A, 15B, 15C, and 15D illustrate perspective, front, and top views of various assemblies of the unique continuous-strut-atop-fence-post fence-post-channel-sealing strut-aligning strut-locking foundation-locking flange fence-post systems, with upper struts continuously running and sitting thereon in a straight shape, angled shape, T shape, or an X shape (in one, two, three, or four ways, respectively).
Figure 15B:
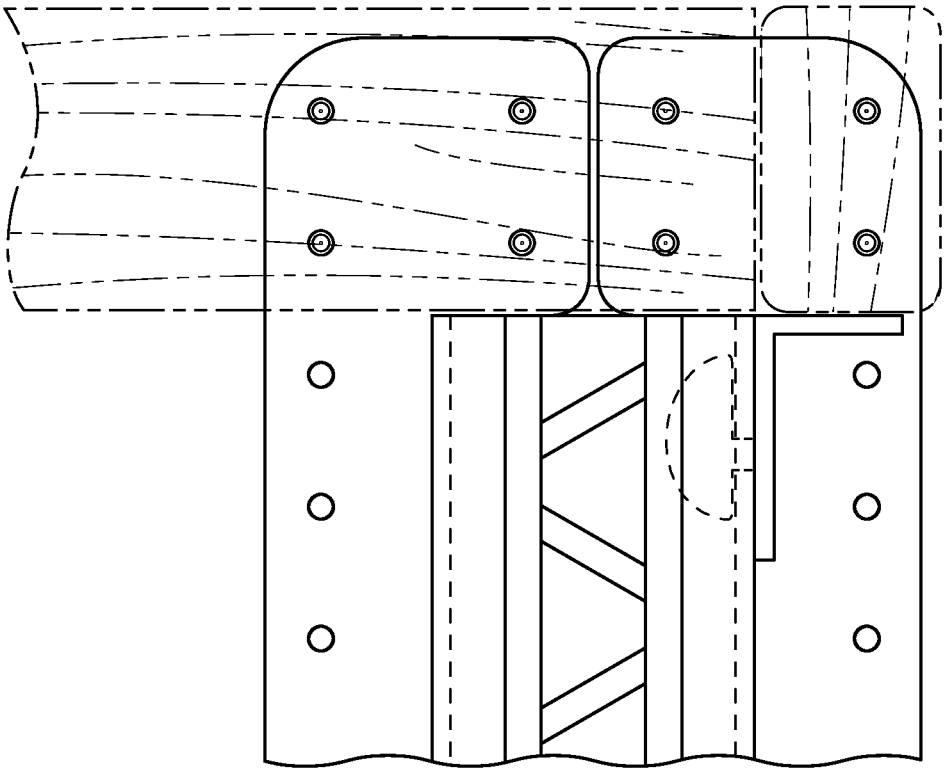
Figure 15C:
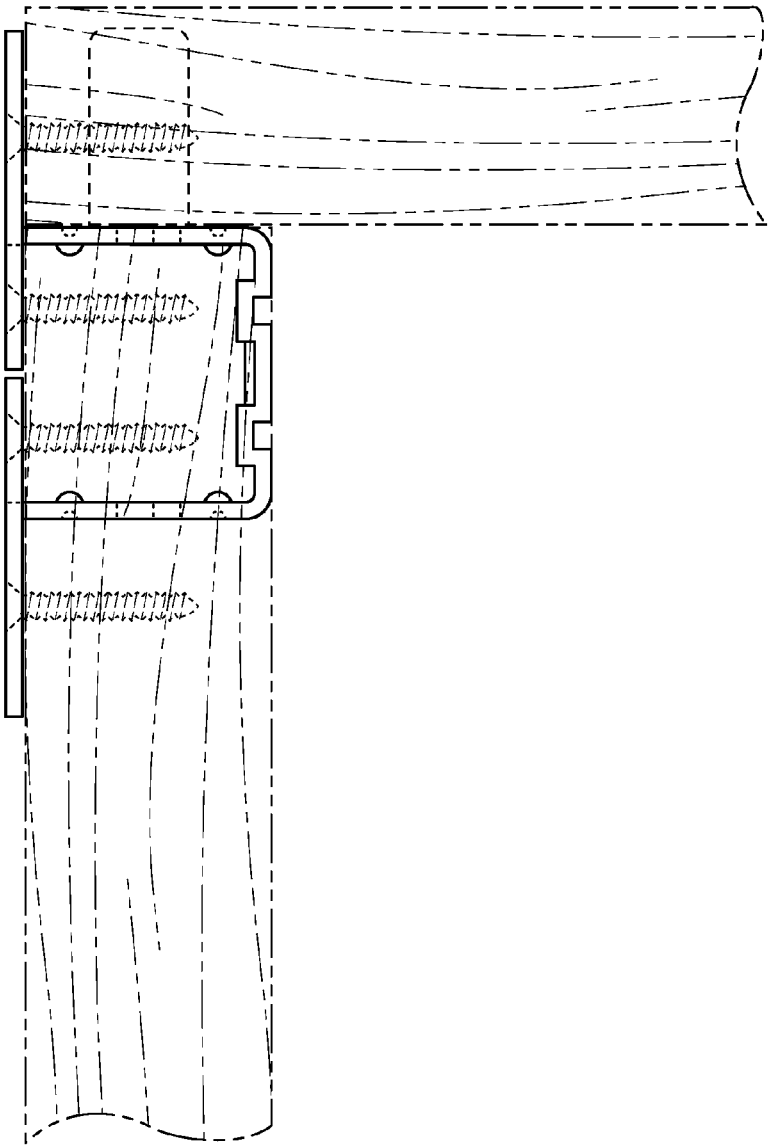
Figure 15D:
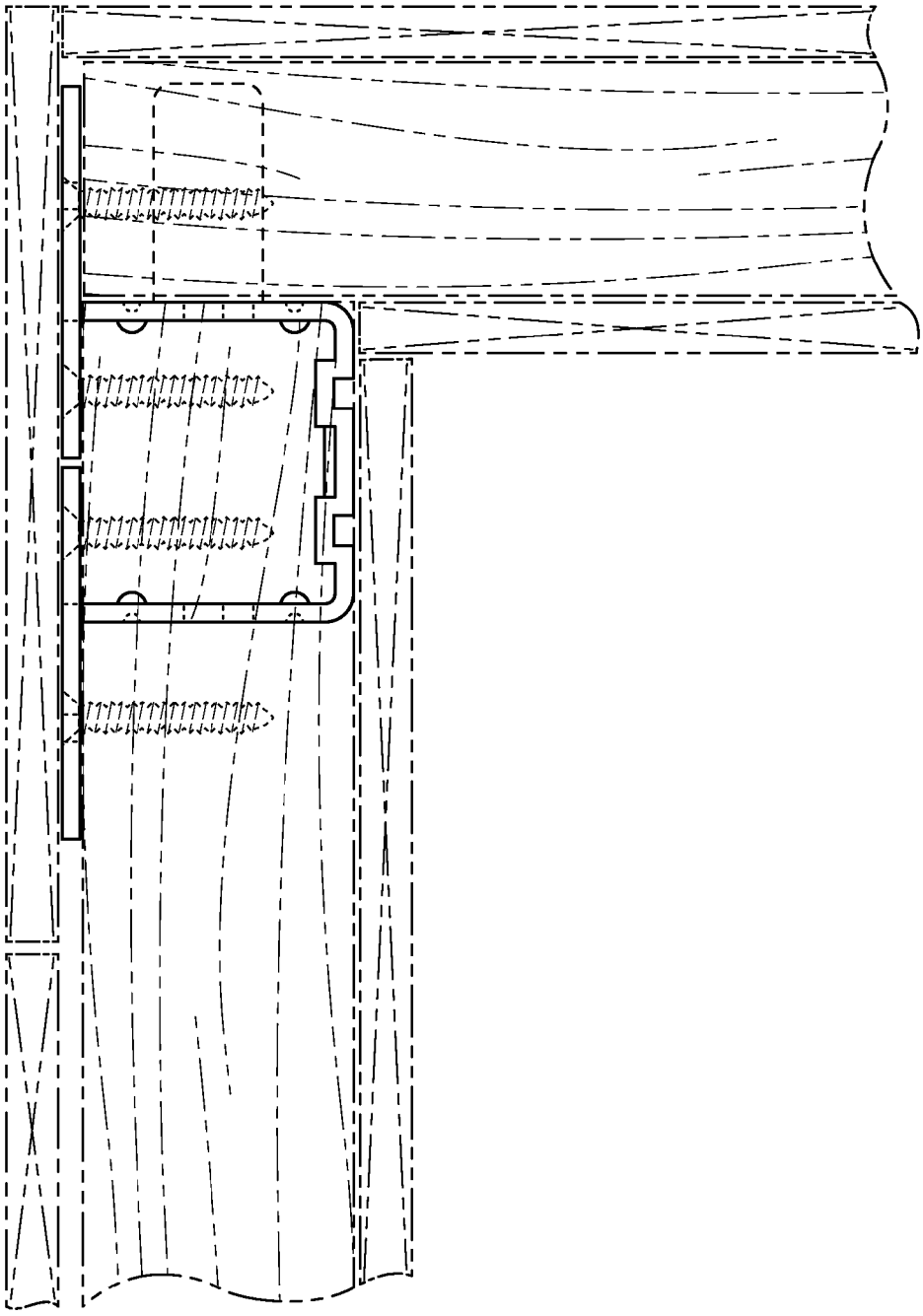
Figure 16A:
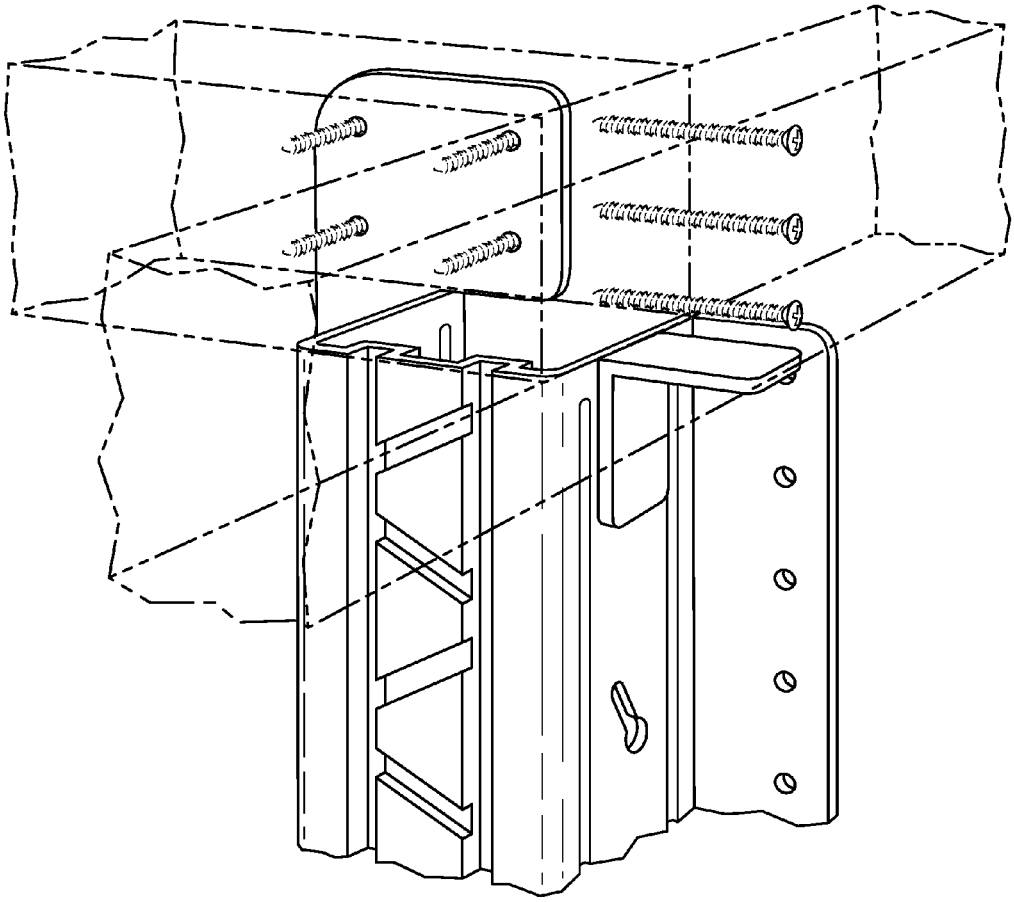
FIGS. 16A, 16B, 17A, 17B, and 17C illustrate perspective views of equivalent variations of the fence-post system, with upper struts continuously running and sitting thereon in a straight shape, angled shape, T shape, or an X shape (in one, two, three, or four ways, respectively).
Figure 16B:
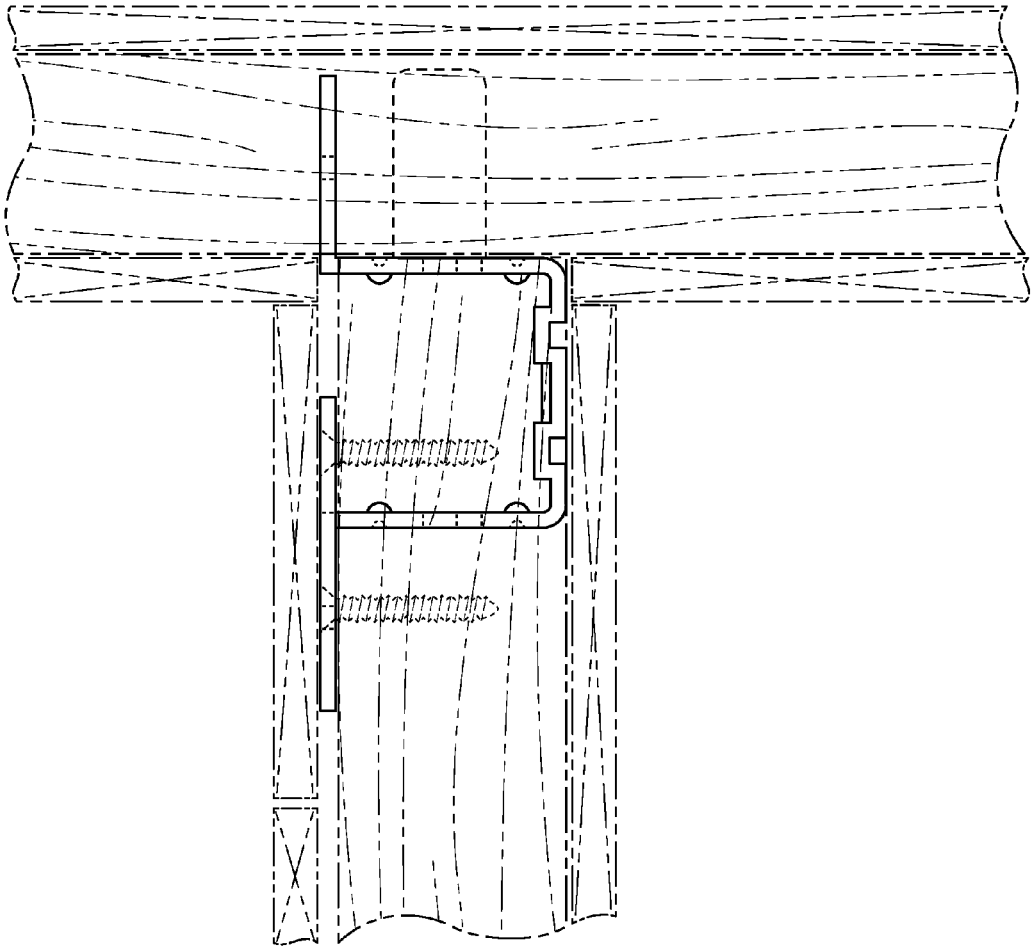
Figure 17A:
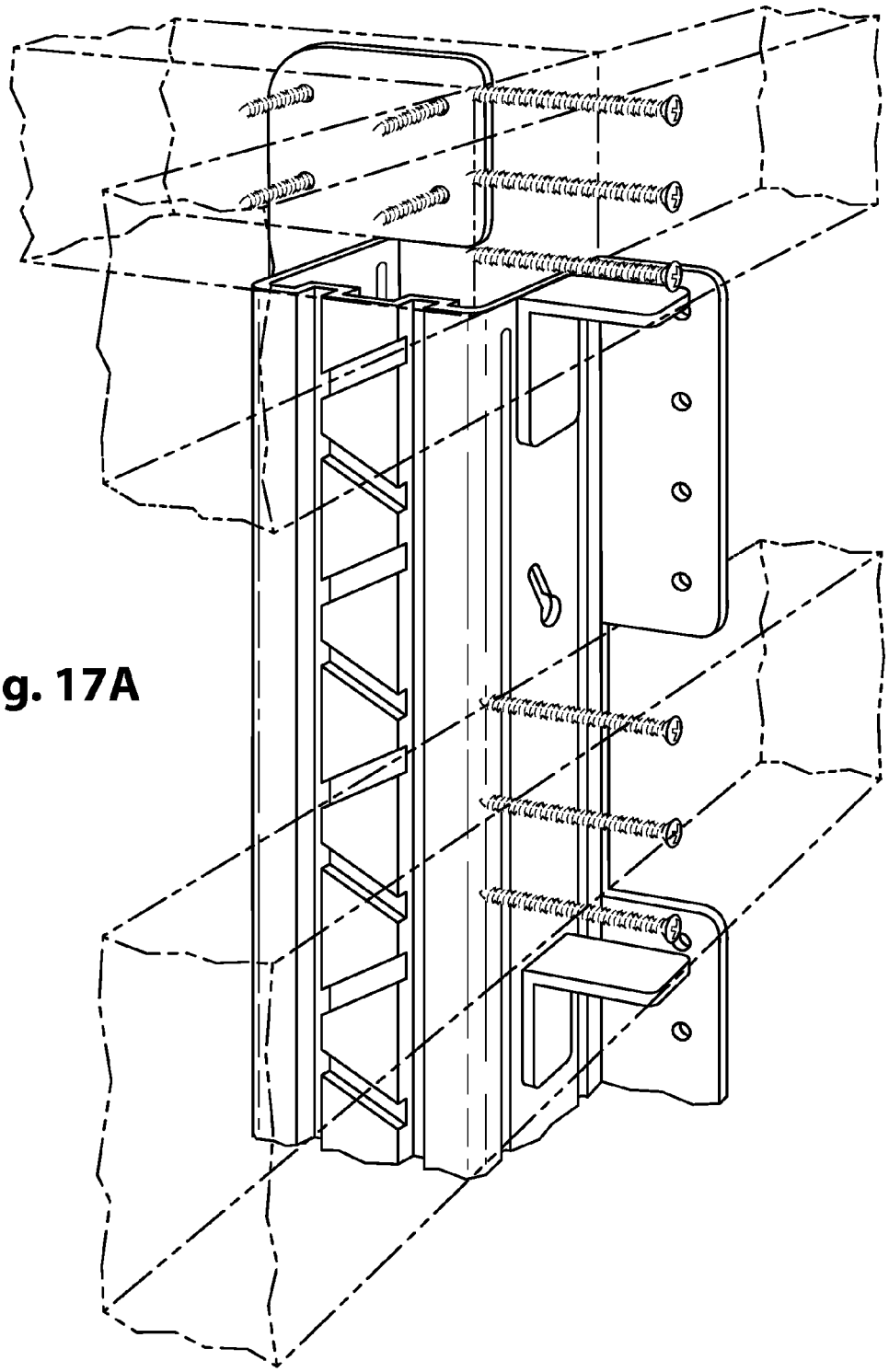
Figure 17B:
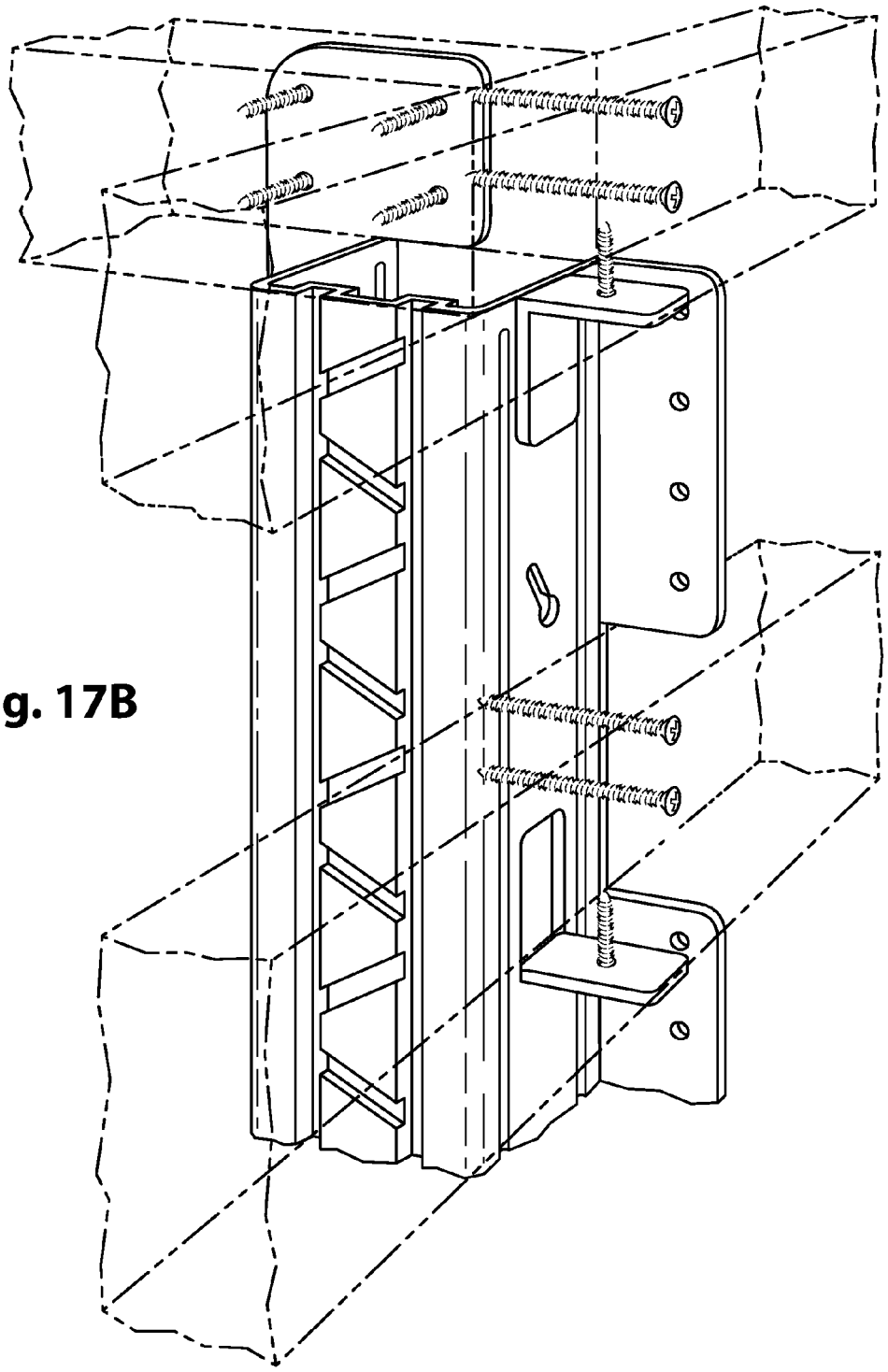
Figure 17C:
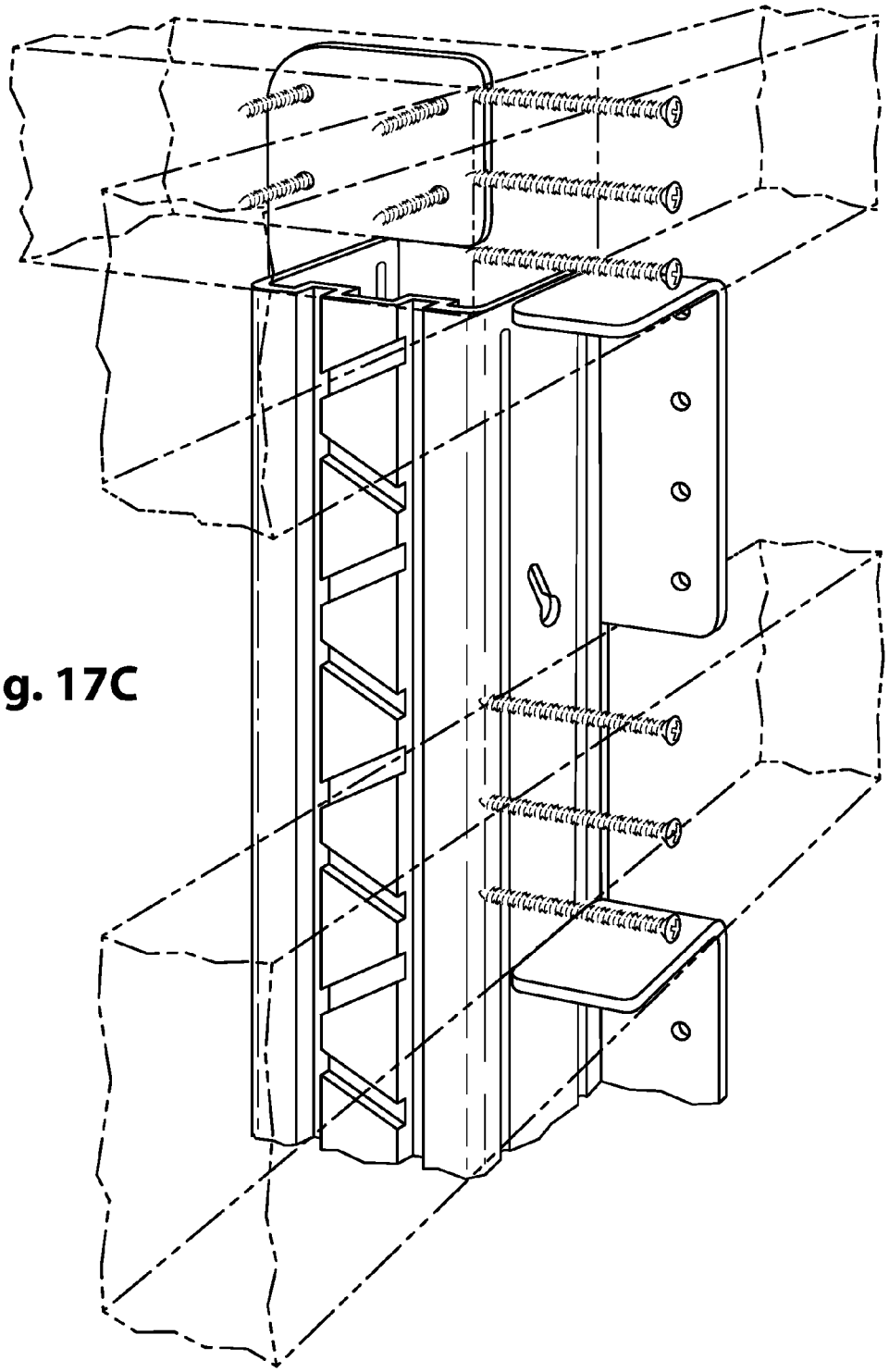

The invention herein may vary. Each component of the unique fence post system disclosed herein, may have any shape and size, and can be connected in any angle and direction. For example, FIGS. 12, 13, and 14 each illustrate an equivalent of fence-post system 101 with upper struts 139 and/or lower struts 140 continuously running and sitting thereon in a straight shape, angled shape, T shape, or an X shape (in one, two, three, or four ways, respectively). Upper struts 139 and/or lower struts 140 can be supported by bracket systems 115, flange systems 120, and/or flange systems 125. Further, FIGS. 15A, 15B, 15C, and 15D each illustrate an equivalent of fence-post system 101 with upper struts 139 continuously running and sitting thereon in a straight shape, angled shape, T shape, or an X shape (in one, two, three, or four ways, respectively). Upper struts 139 and/or lower struts 140 can be supported by bracket systems 115, flange systems 120, and/or flange systems 125. Additionally FIGS. 16A, 16B, 17A, 17B, and 17C each illustrate an equivalent of fence-post system 101 with upper struts 139 continuously running and sitting thereon in a straight shape, angled shape, T shape, or an X shape (in one, two, three, or four ways, respectively). Upper struts 139 and/or lower struts 140 can be supported by bracket systems 115, flange systems 120, and/or flange systems 125.

Figure 18A:
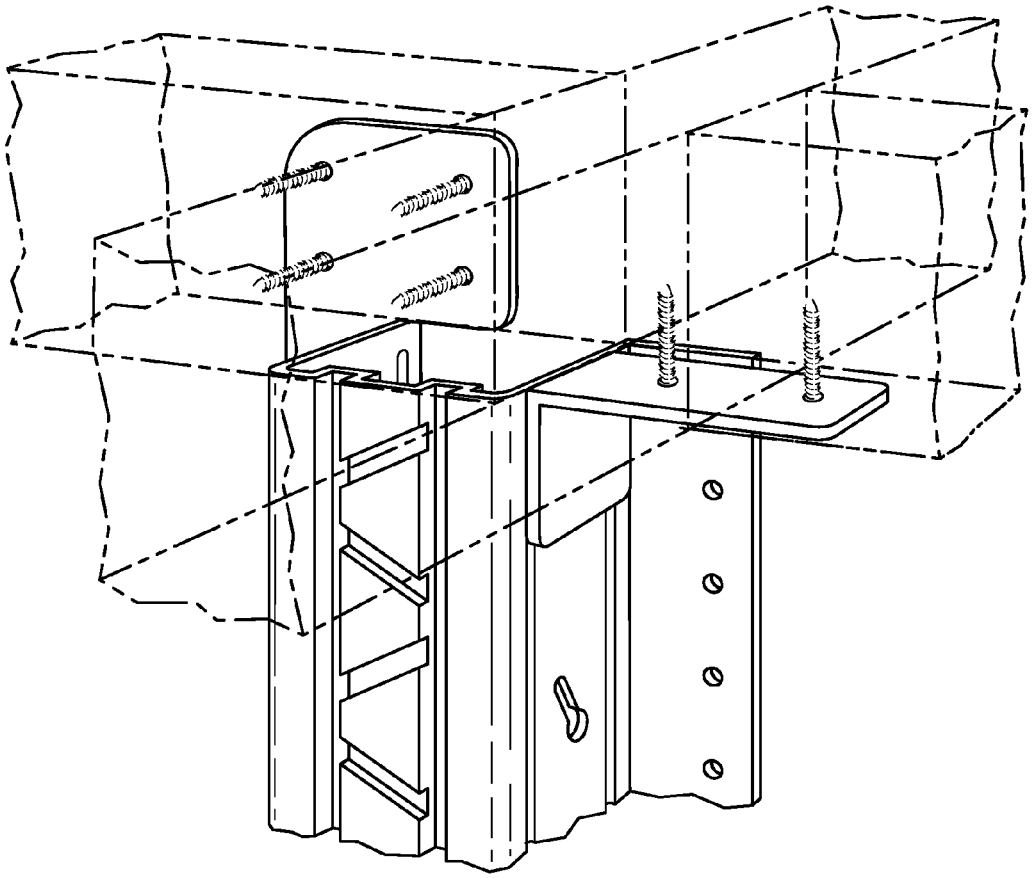
FIGS. 18A, 18B, and 19 each illustrate an equivalent of fence-post system 101 with upper struts 139 continuously running and sitting thereon in a straight shape, angled shape, T shape, or an X shape (in one, two, three, or four ways, respectively).
Figure 18B:
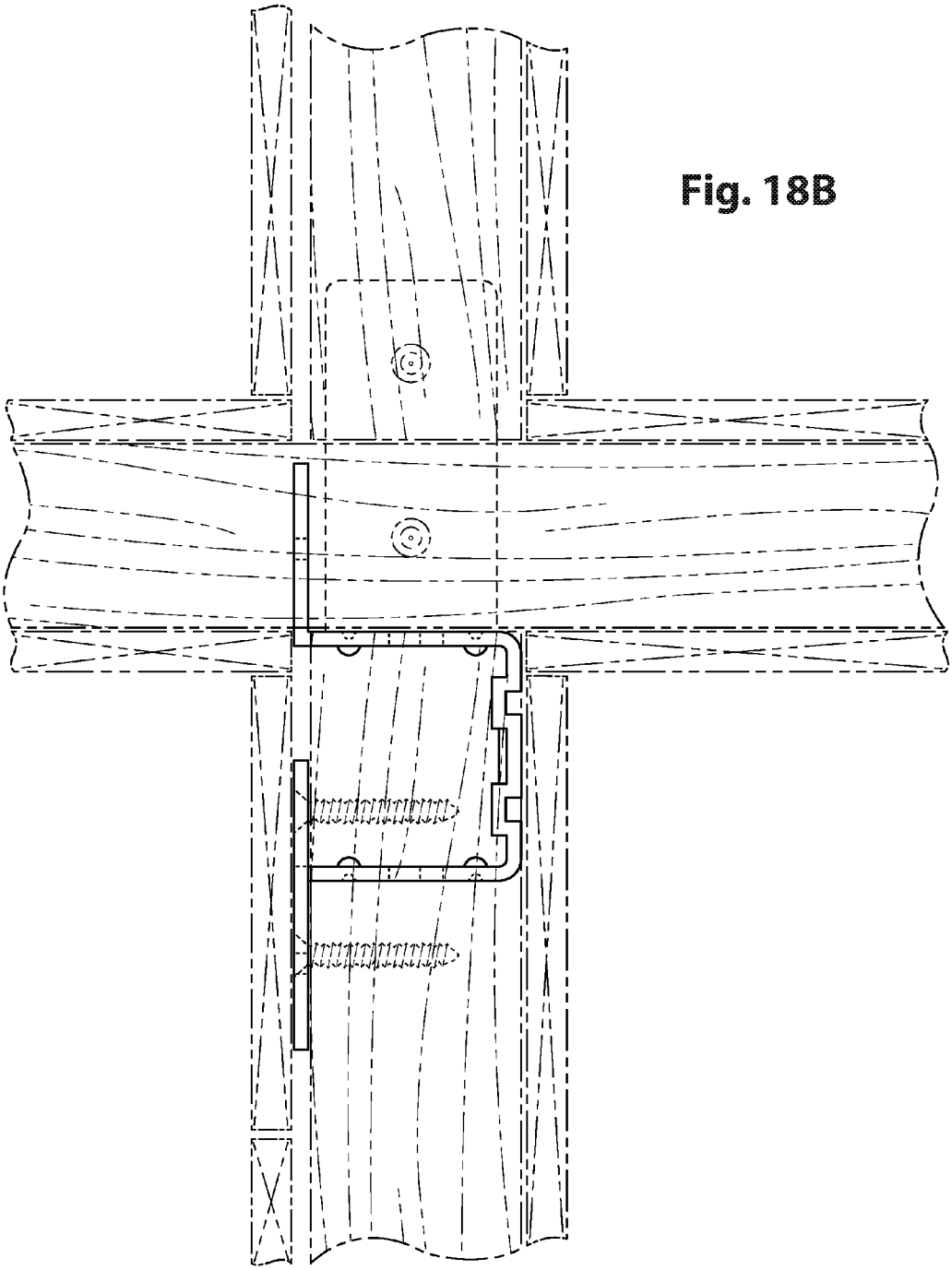
Figure 19:
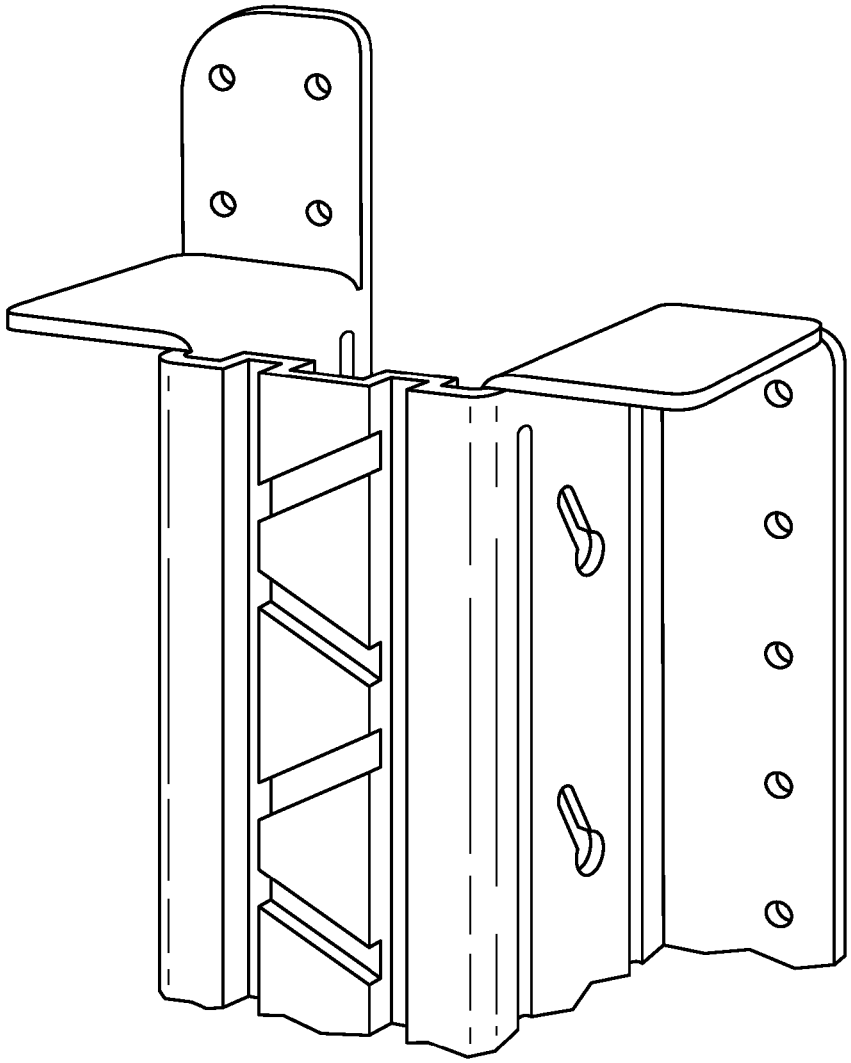

Further variations and alternative embodiments include FIGS. 18A, 18B, and 19 each illustrate an equivalent of fence-post system 101 with upper struts 139 continuously running and sitting thereon in a straight shape, angled shape, T shape, or an X shape (in one, two, three, or four ways, respectively). Upper struts 139 and/or lower struts 140 can be supported by bracket systems 115, flange systems 120, and/or flange systems 125.

Each of fence post system embodiments can be built with or without any of its components.

For example, each of the fence-post systems can be built with or without system 108 and/or system 112.

Each of the unique fence-post systems can have at least one of any of its components. For example, FIG. 17 illustrates the unique continuous-strut-atop-fence-post fence-post-channel-sealing strut-aligning strut-locking foundation-locking flange fence-post systems, having one upper left strut-aligning foundation-locking flange body 121.

Figure 20A:
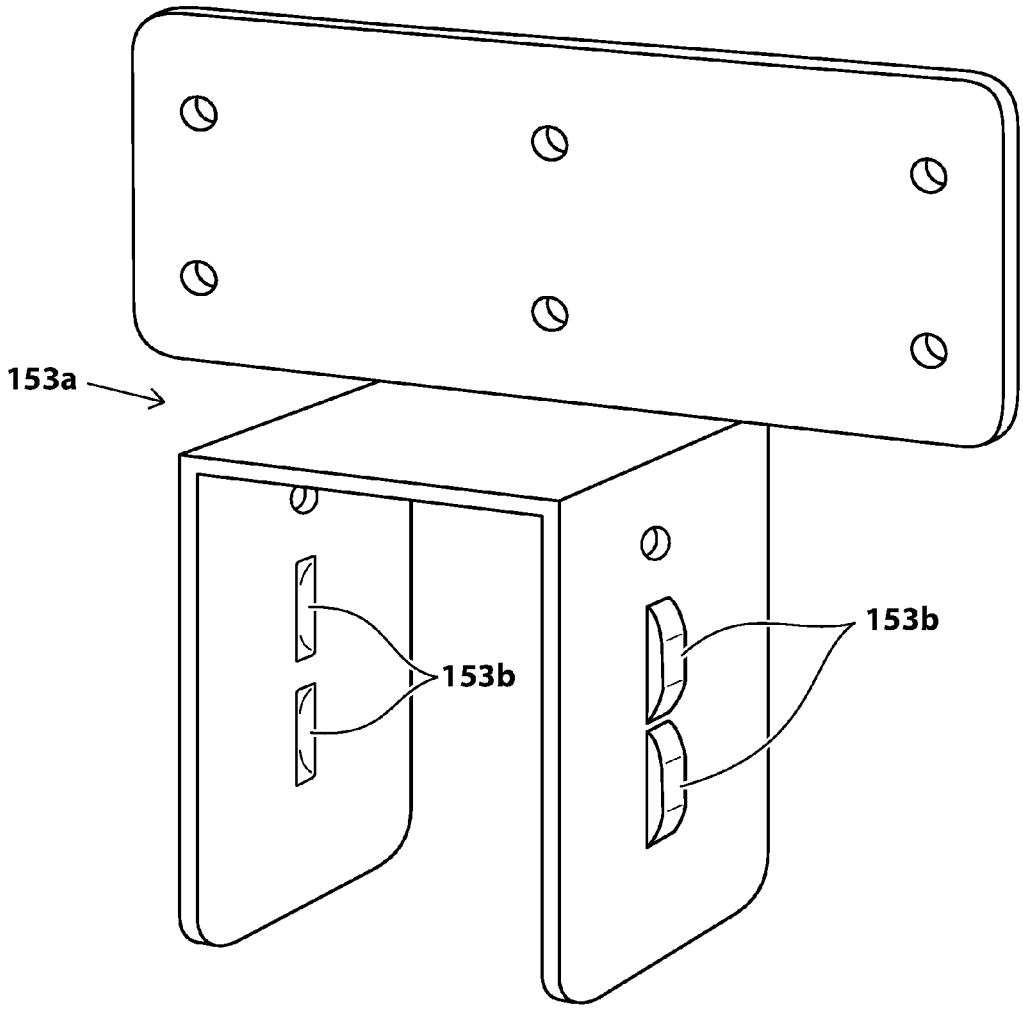
FIGS. 20A, 20B, 21A, 21B, 22A, 22B, 23A, and 23B illustrate perspective views of equivalent variations of the unique continuous-strut-atop-fence-post fence-post-channel-sealing strut-aligning strut-locking foundation-locking flange fence-post systems.
Figure 20B:
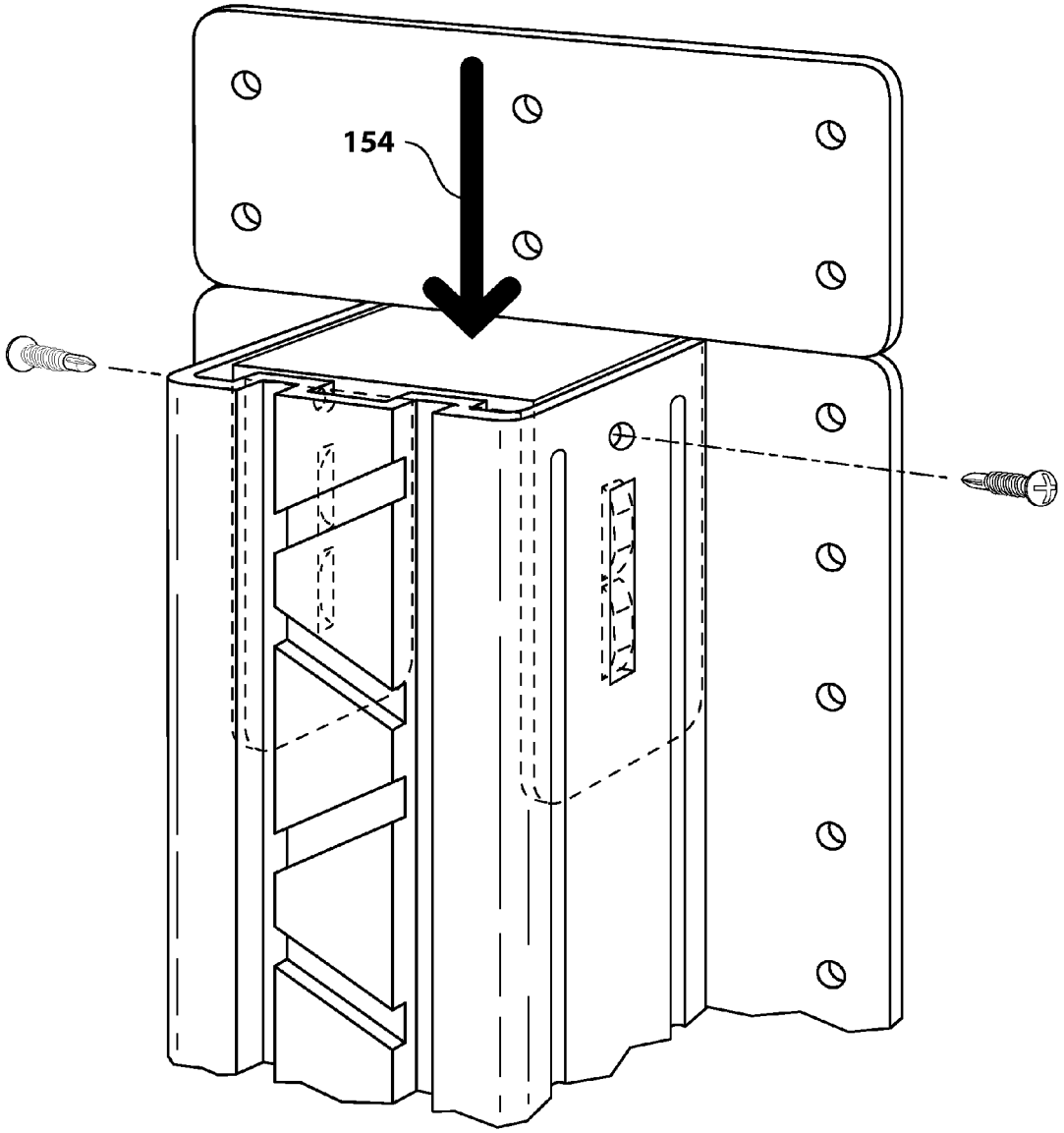

FIGS. 20A and 20B illustrate an equivalent system to the unique continuous-strut-atop-fence-post fence-post-channel-sealing strut-aligning strut-locking foundation-locking flange fence-post systems. The equivalent system has a cap 153*a* and snap locks 153*b*, being snap-locked on each end of the equivalent system, in the direction of arrow 154.

Figure 21A:
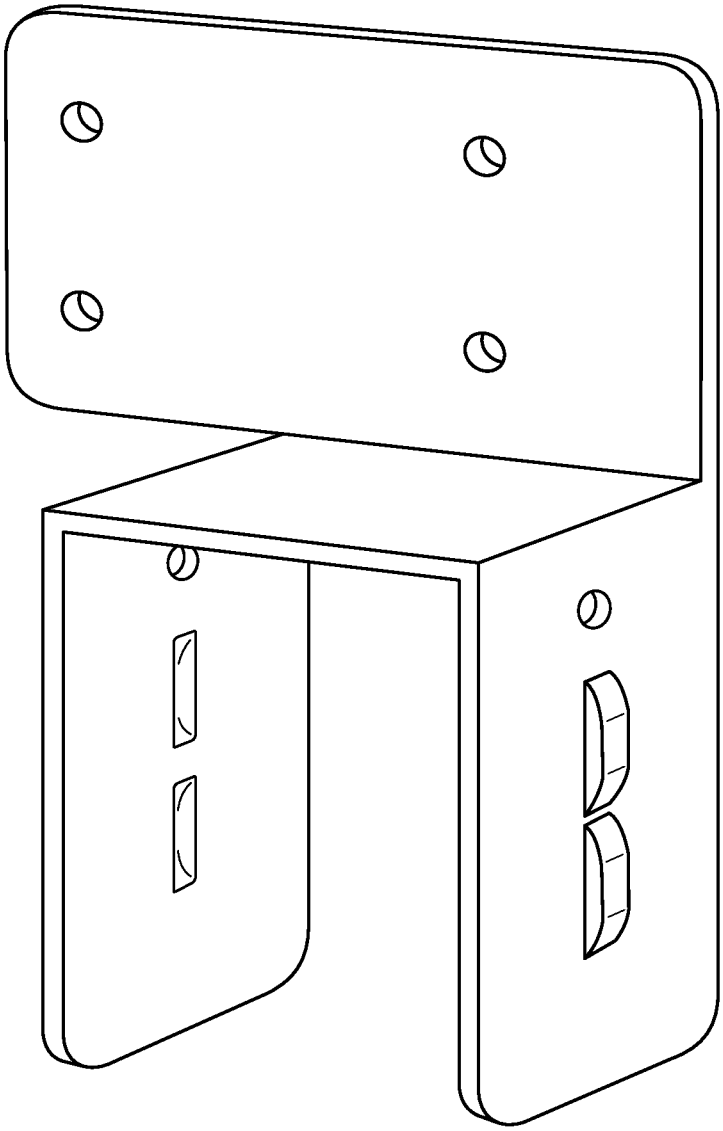
Figure 21B:
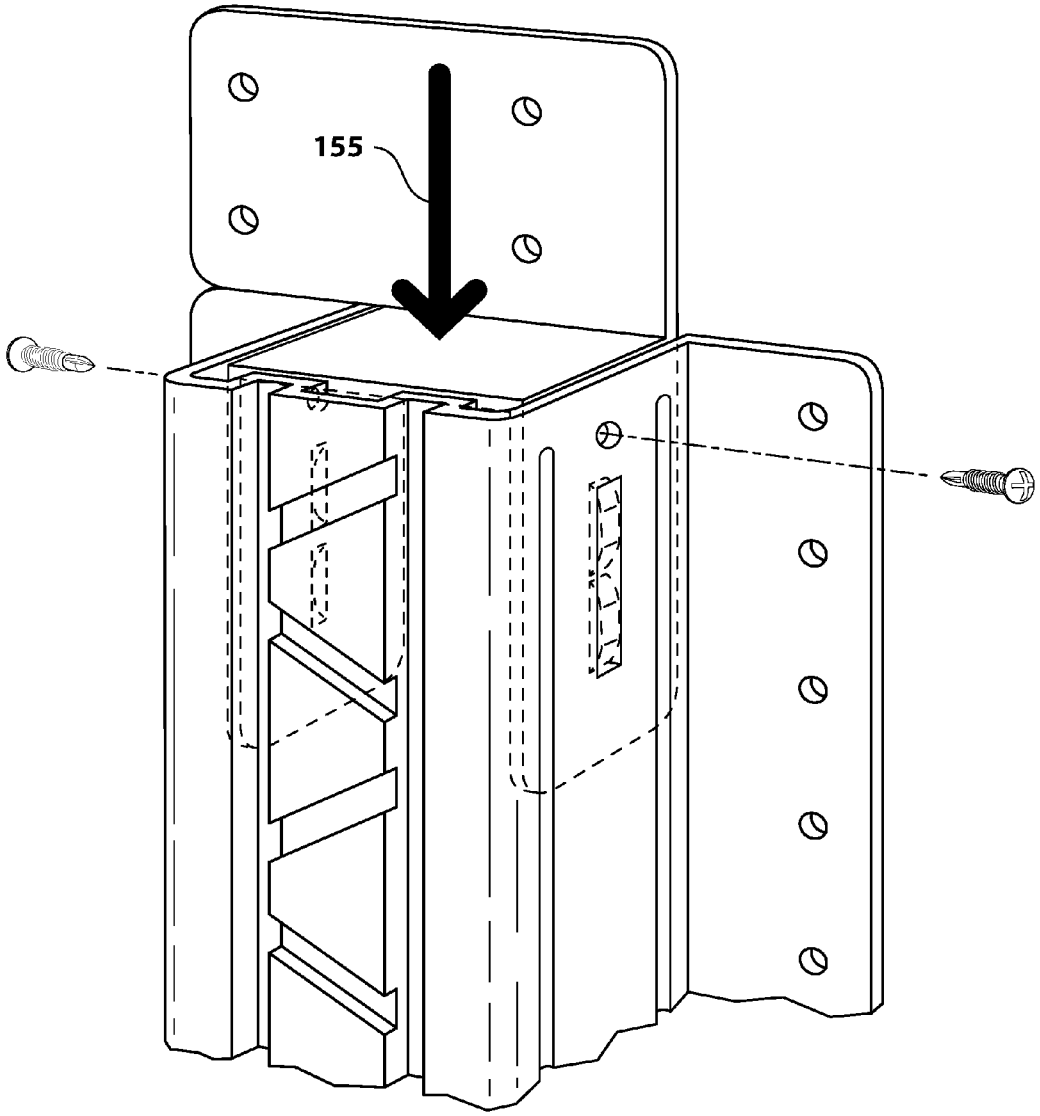

FIGS. 21A and 21B illustrate an equivalent system to the unique continuous-strut-atop-fence-post fence-post-channel-sealing strut-aligning strut-locking foundation-locking flange fence-post systems. The equivalent system has a cap and snap locks, being snap-locked on each end of the equivalent system, in the direction of arrow 155.

Figure 22A:
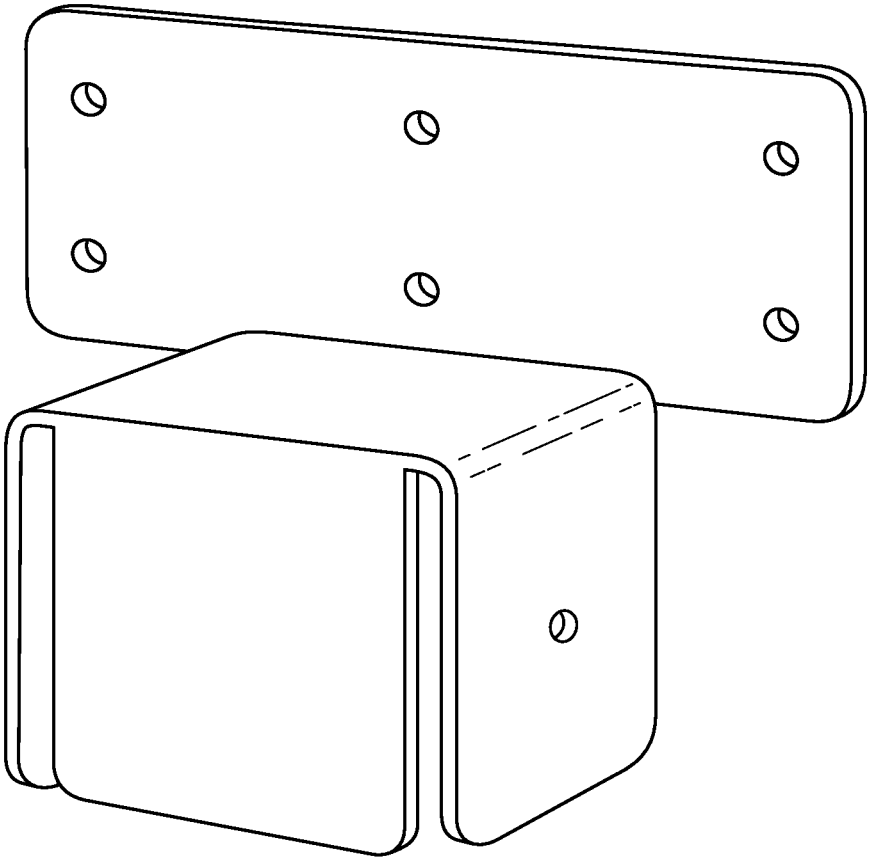
Figure 22B:
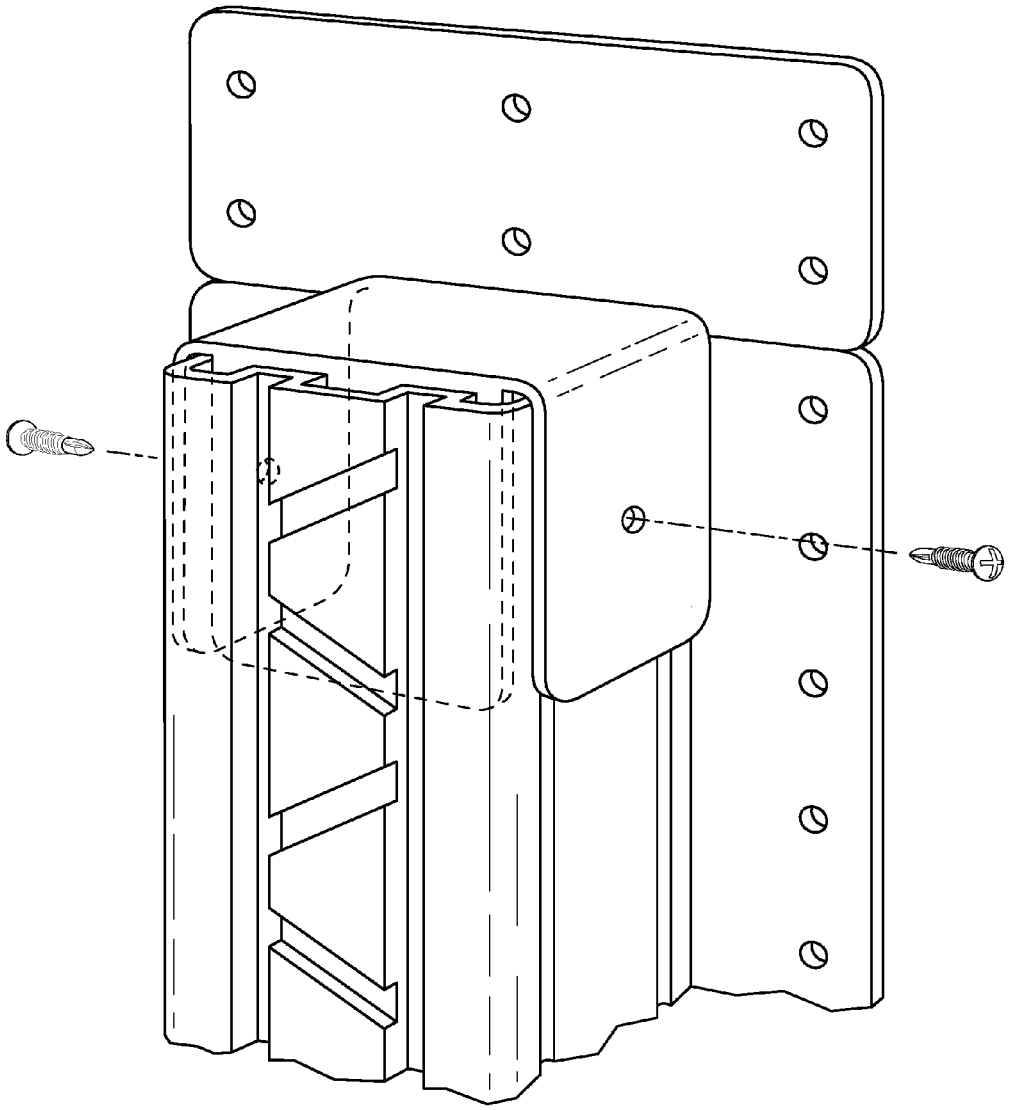

FIGS. 22A and 22B illustrate an equivalent system to the unique continuous-strut-atop-fence-post fence-post-channel-sealing strut-aligning strut-locking foundation-locking flange fence-post systems. The equivalent system has a cap and snap locks, being screwed on each end of the equivalent system.

Figure 23A:
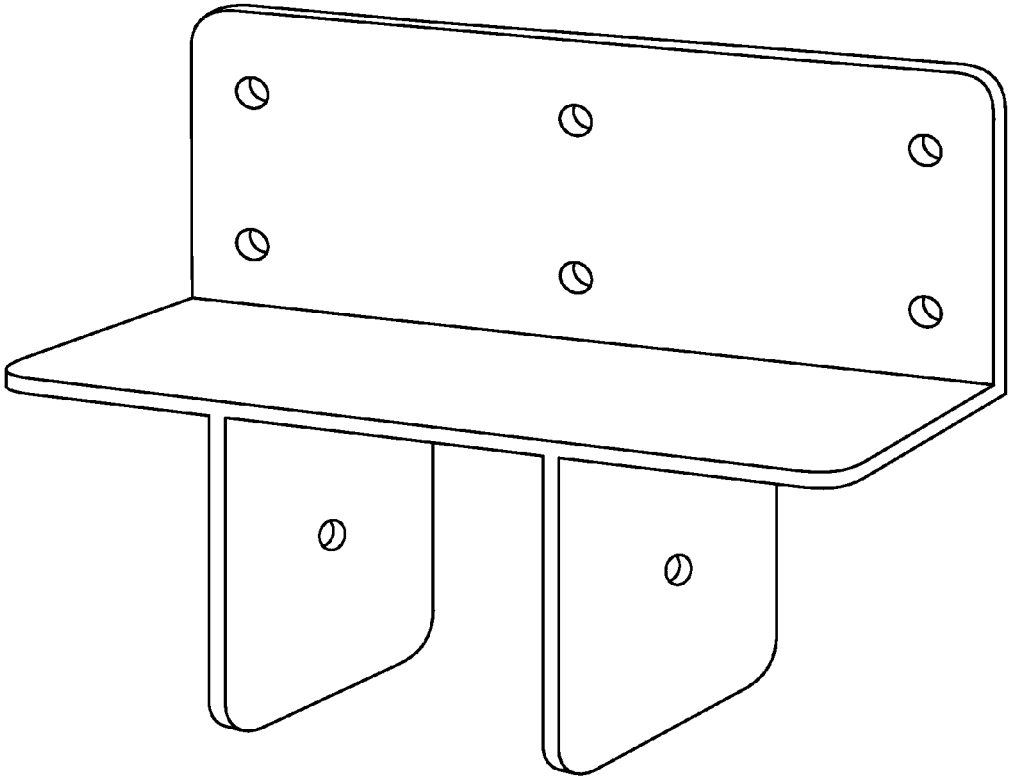
Figure 23B:
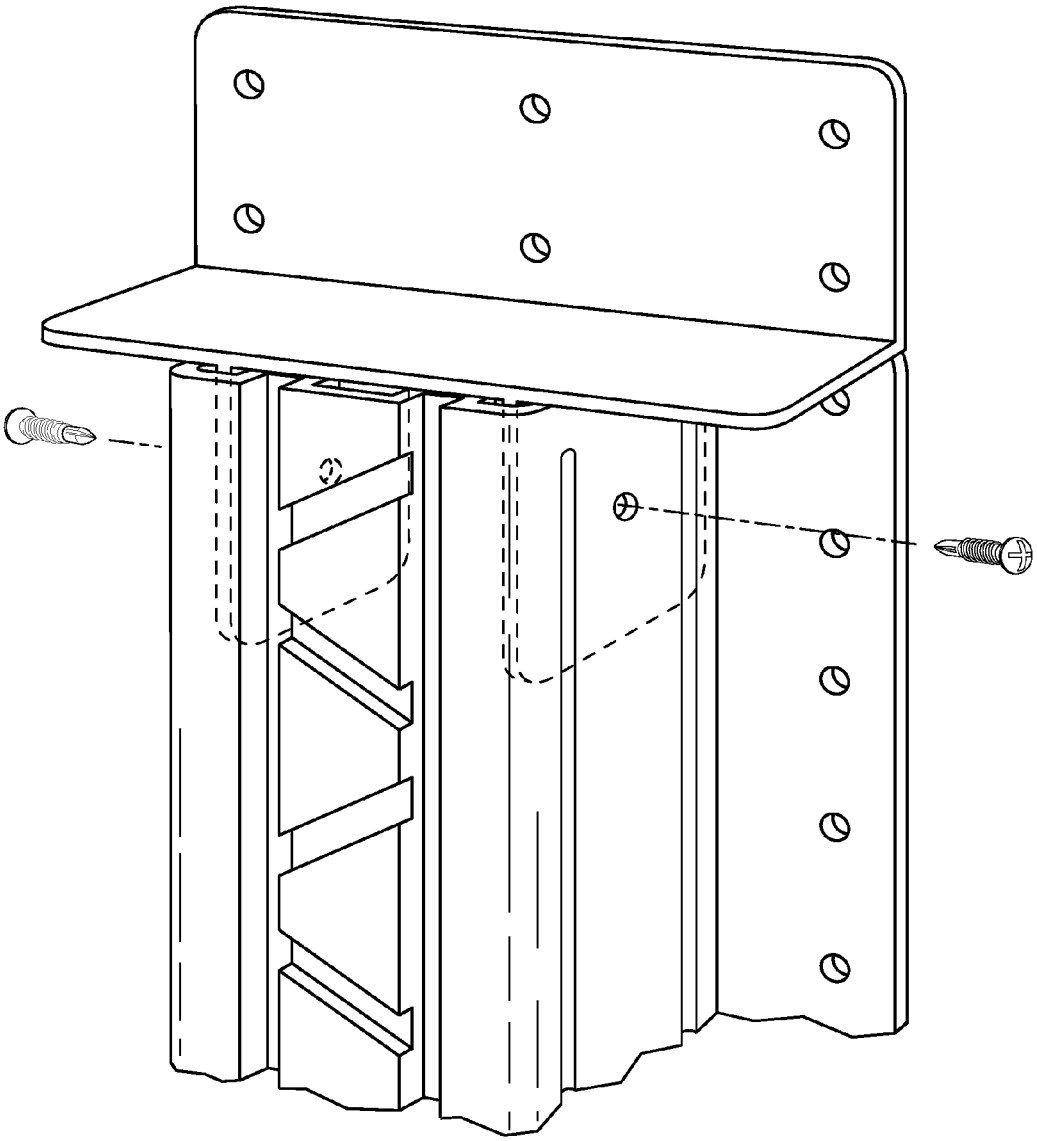

FIGS. 23A and 23B illustrate an equivalent system to the unique continuous-strut-atop-fence post fence-post-channel-sealing strut-aligning strut-locking foundation-locking flange fence-post systems. The equivalent system has a cap and snap locks, being screwed on each end of the equivalent system.

FIGS. 24A, 24B, and 24C illustrate side, front, and top views of an equivalent of L-shaped bracket system 130 or L-shaped bracket system 134.

Figure 25:
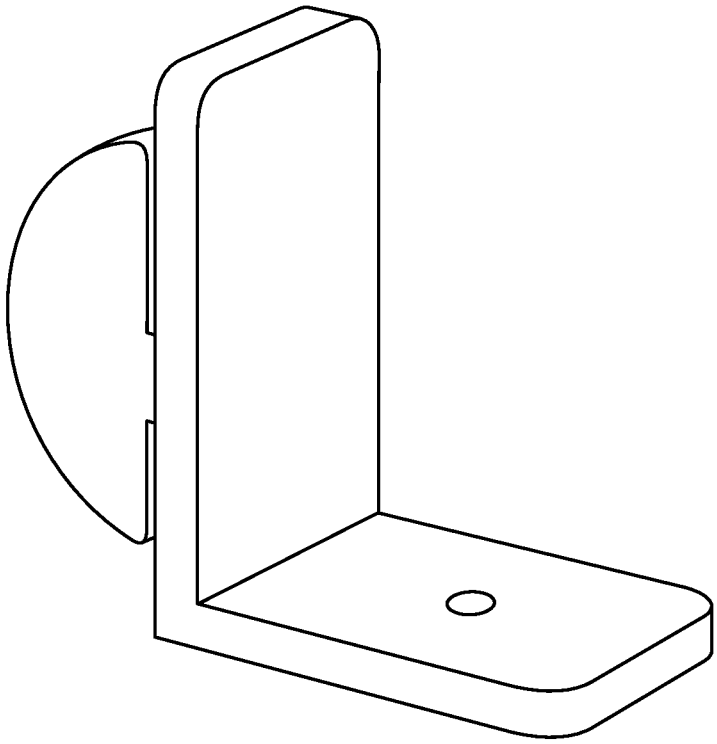
FIG. 25 illustrates a perspective view of an equivalent of the right-side-up L-shaped bracket system or the upside-down L-shaped bracket system.

FIG. 25 illustrates a perspective view of an equivalent of L-shaped bracket system 130 or L-shaped bracket system 134. The equivalent can have at least one screw hole for at least one screw (for example, tapping screw) to be screwed therethrough into the unique continuous-strut-atop-fence-post fence-post-channel-sealing strut-aligning strut-locking foundation-locking flange fence-post systems, fence-post system 101, vertical bracket system 115, upper flange system 120, lower flange system 125, upper strut 139, and/or lower strut 140.

Figure 26A:
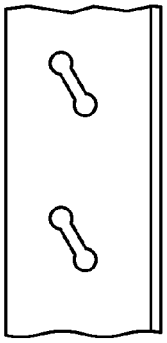
FIGS. 26A, 26B, and 26C illustrate side views of equivalent variations of the angled L-shaped-bracket openings.
Figure 26B:
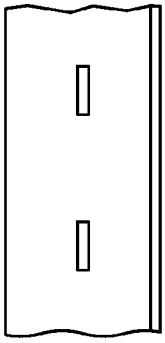
Figure 26C:
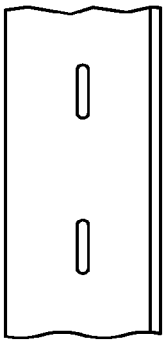

FIGS. 26A, 26B, and 26C illustrate side views of equivalent variations of angled L-shaped-bracket openings 106.

Figure 27A:
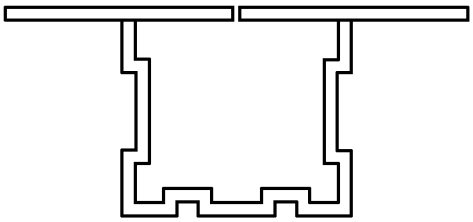
FIGS. 27A, 27B, and 27C illustrate top views of equivalent variations of the unique continuous-strut-atop-fence-post fence-post-channel-sealing strut-aligning strut-locking foundation-locking flange fence-post systems.
Figure 27B:
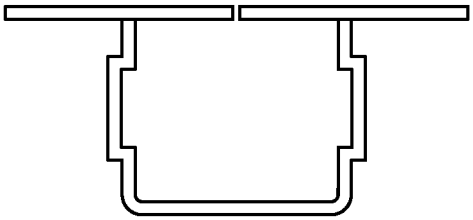
Figure 27C:
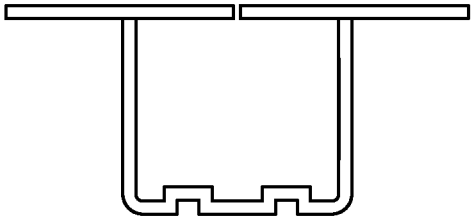

FIGS. 27A, 27B, and 27C illustrate top views of equivalent variations of fence-post system 101.

Figure 28:
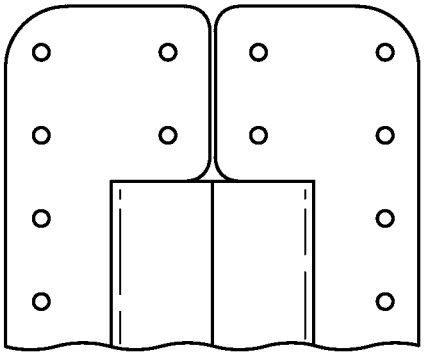
FIG. 28 illustrates a front view of an equivalent of the unique continuous-strut-atop-fence-post fence-post-channel-sealing strut-aligning strut-locking foundation-locking flange fence-post systems. The equivalent has an M-shaped cross-section.

FIG. 28 illustrates a front view of an equivalent of the unique continuous-strut-atop-fence-post fence-post-channel-sealing strut-aligning strut-locking foundation-locking flange fence-post systems. The equivalent has an M-shaped cross-section.

Figure 29:
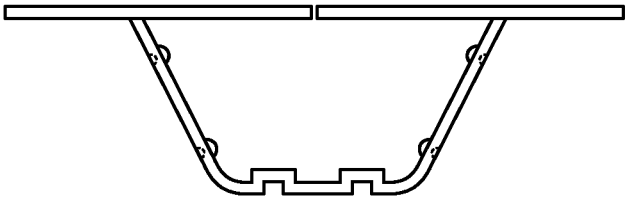
FIG. 29 illustrates a top view of an equivalent of the unique continuous-strut-atop-fence-post fence-post-channel-sealing strut-aligning strut-locking foundation-locking flange fence-post systems. The equivalent is stackable.

FIG. 29 illustrates a top view of an equivalent of the unique continuous-strut-atop-fence-post fence-post-channel-sealing strut-aligning strut-locking foundation-locking flange fence-post systems. The equivalent is stackable.

Figure 30:
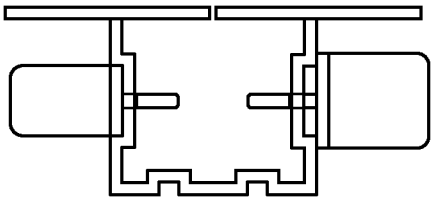
FIG. 30 illustrates a top view of an equivalent of the right-side-up L-shaped bracket system or the upside-down L-shaped bracket system, being hooked on an equivalent of the unique continuous-strut-atop-fence-post fence-post-channel-sealing strut-aligning strut-locking foundation-locking flange fence-post systems.

FIG. 30 illustrates a top view of an equivalent of L-shaped bracket system 130 or L-shaped bracket system 134, being hooked on an equivalent of fence-post system 101.

Figure 31:
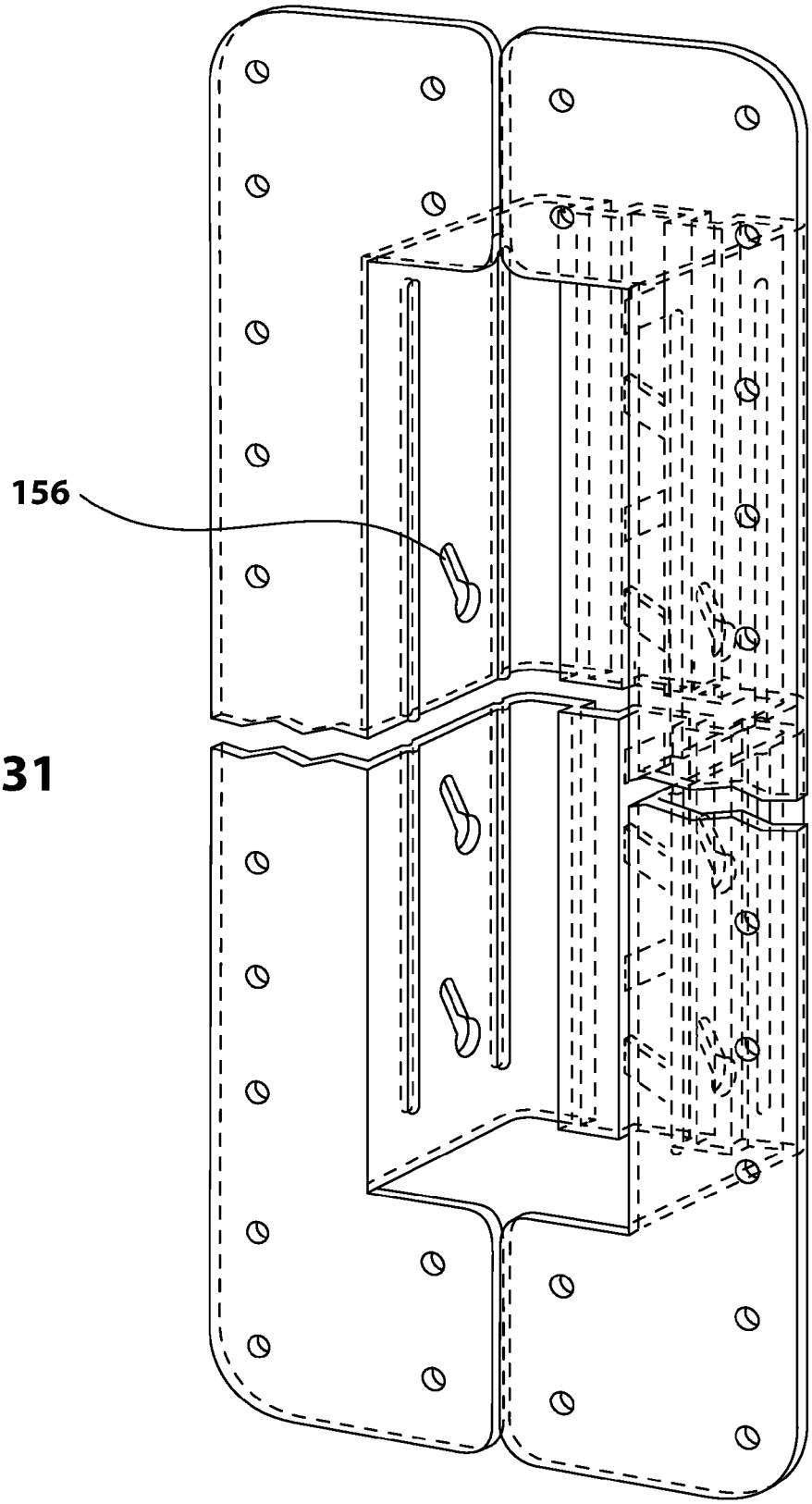
FIG. 31 illustrates a perspective view of an equivalent variation of the angled L-shaped-bracket openings.

FIG. 31 illustrates a perspective view of an equivalent variation 156 of angled L-shaped-bracket openings 106.

Figure 32:
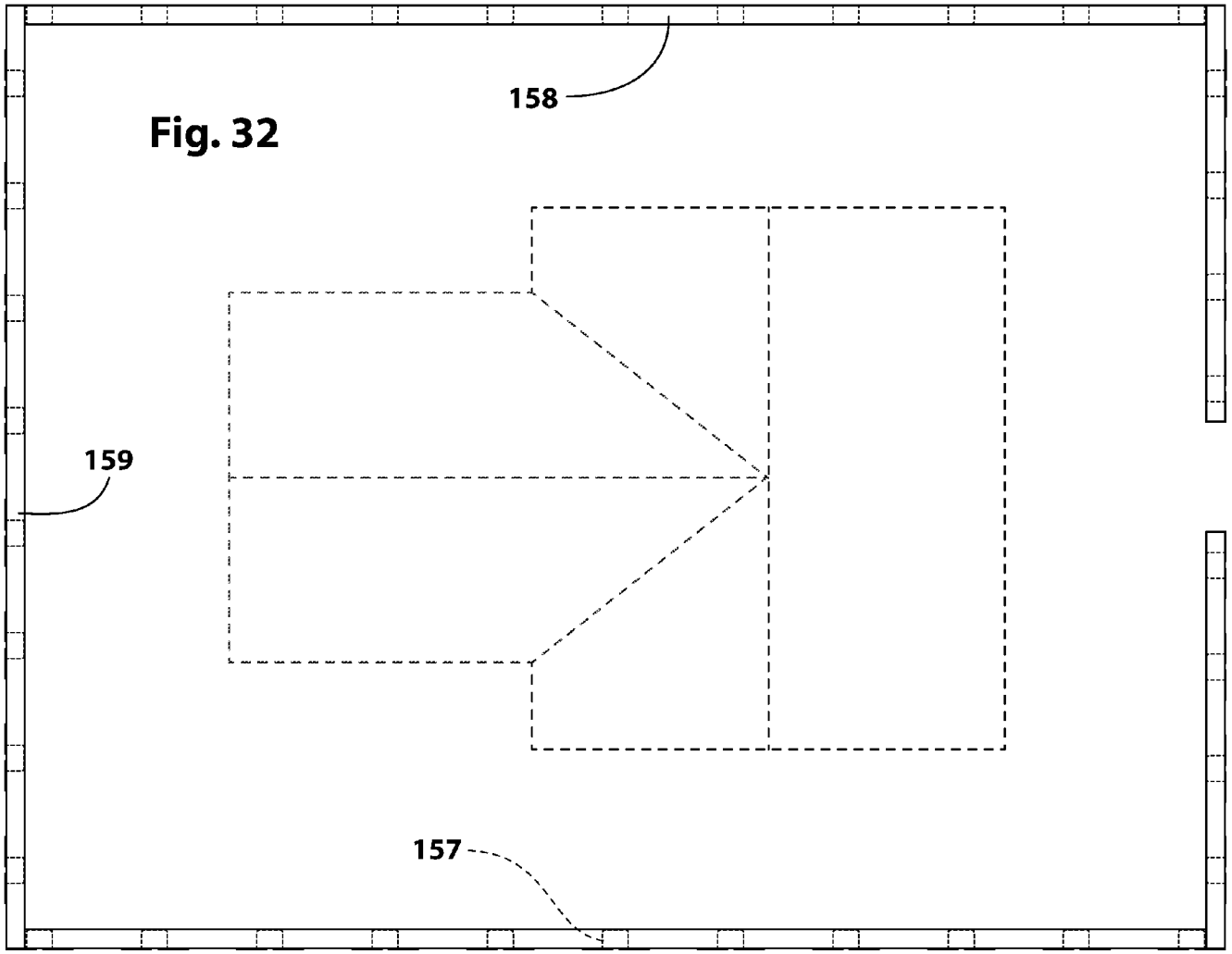
FIG. 32 illustrates a top view of the unique continuous-strut-atop-fence-post fence-post-channel-sealing strut-aligning strut-locking foundation-locking flange fence-post systems, which allow one continuous strut to run the whole length of the sides of the house fence.

FIG. 32 illustrates a top view of the unique fence-post systems, which allow for one continuous strut 157 to run the whole length of the left side of the house fence (atop all fence-post systems 101 of the left side of the house fence), one continuous strut 158 to run the whole length of the right side of the house fence (atop all fence-post systems 101 of the right side of the house fence), and for one continuous strut 159 to run the whole length of the rear side of the house fence (atop all fence-post systems 101 of the rear side of the house fence).

Each component of the unique fence-post systems can have any shape and size. Each component of the fence-post systems can be created at any angle, slope, grade, direction, or orientation, relative to any other component of the unique fence-post systems. For example, an equivalent variation of L-shaped-bracket body 131 or L-shaped-bracket body 135 can comprise L-shaped-bracket body 131 or L-shaped-bracket body 135, which extends its two-sided body at at least one of its edges at a ninety-degree angle to form a three-sided or four-sided bracket body having at least one screw hole at at least one predetermined location thereon. Additionally the L-shaped-bracket body 131 or L-shaped-bracket body 135 can have at least one screw hole at at least one predetermined location thereon.

What is claimed is:

1. A fence-post system comprising:

a plurality of fence posts, each comprising:

a central section, two opposite flank sections molded to ends of said central section to form a U shape, and a plurality of angled openings punch-pressed in said two opposite flank sections, a plurality of anti-bending-and-anti-warping ribs formed on said central sections of said fence posts, a plurality of anti-clockwise-torsion-and-anti-counter-clockwise-torsion ribs formed on said central sections of said fence posts, two opposite vertical-bracket bodies molded to ends of said two opposite flank sections respectively, opposite the central section, with a plurality of vertical-bracket holes drilled in said vertical-bracket bodies respectively, two opposite upper flange bodies, said two opposite flank sections having two opposite upper ends, said two opposite upper flange bodies molded to said two opposite upper ends respectively, with a plurality of upper flange holes drilled in said two opposite upper flange bodies respectively, two opposite lower flange bodies, said two opposite flank sections having two opposite lower ends, said two opposite lower flange bodies molded to said two opposite lower ends respectively, with a plurality of lower flange holes drilled in said two opposite lower flange bodies respectively;

an L-shaped bracket system comprising:

a plurality of L-shaped-bracket bodies, a plurality of L-shaped-bracket hooks molded to said L-shaped-bracket bodies respectively, and a plurality of L-shaped-bracket fangs molded to said L-shaped-bracket hooks respectively, wherein said L-shaped-bracket bodies are attached to said fence posts by rotatingly engaging said L-shaped-bracket hooks into said angled openings such that a portion of the L-shaped-bracket bodies extends outward from a respective one of said two opposite flank sections; and a fence system comprising:

a plurality of upper struts, each seated on a respective fence-post top of at least one of said fence posts, a plurality of lower struts each engaged with at least one of said two opposite vertical-bracket bodies, and with at least one of said L-shaped-bracket bodies, and a plurality of fence boards screwed on said upper struts and said lower struts.

2. The fence-post system of claim 1, wherein, each of said angled openings has a dumb-bell shape.

3. The fence-post system of claim 1, wherein, each of said angled openings has a key-hole shape.

4. The fence-post system of claim 1, wherein, each of said upper and lower flange bodies has a generally rectangular shape.

5. The fence-post system of claim 1, wherein, each of said upper and lower flange bodies has a generally square shape.

6. The fence-post system of claim 1, wherein, each of said anti-bending-and-anti-warping ribs is vertical.

7. The fence-post system of claim 1, wherein, each of said anti-clockwise-torsion-and-anti-counterclockwise-torsion ribs is angled.

8. The fence-post system of claim 1, further, comprising at least one powder-coat applied on said fence posts, said upper flange bodies, and said lower flange bodies.

9. The fence-post system of claim 1, further, comprising a base-coat, a gel-coat, and a top-coat applied on each of said fence posts, said upper flange bodies, and said lower flange bodies.

10. A fence-post system comprising:

a plurality of fence posts, each comprising:

a central section, two opposite flank sections molded to ends of said central section to form a U shape, and a plurality of angled openings punch-pressed in said two opposite flank sections, a plurality of anti-bending-and-anti-warping ribs formed on said central sections of said fence posts, a plurality of anti-clockwise-torsion-and-anti-counter-clockwise-torsion ribs formed on said central sections of said fence posts, two opposite vertical-bracket bodies molded to ends of said two opposite flank sections respectively, opposite the central section, with a plurality of vertical-bracket holes drilled in said vertical-bracket bodies respectively, two opposite upper flange bodies, said two opposite flank sections having two opposite upper ends, said two opposite upper flange bodies molded to said two opposite upper ends respectively, with a plurality of upper flange holes drilled in said two opposite upper flange bodies respectively, two opposite lower flange bodies, said two opposite flank sections having two opposite lower ends, said two opposite lower flange bodies molded to said two opposite lower ends respectively, with a plurality of lower flange holes drilled in said two opposite lower flange bodies respectively;

an L-shaped bracket system comprising:

a plurality of L-shaped-bracket bodies, a plurality of L-shaped-bracket hooks molded to said L-shaped-bracket bodies respectively, and a plurality of L-shaped-bracket fangs molded to said L-shaped-bracket hooks respectively, wherein said L-shaped-bracket bodies are attached to said fence posts by rotatingly engaging said L-shaped-bracket hooks into said angled openings such that a portion of the L-shaped-bracket bodies extends outward from a respective one of said two opposite flank sections; and a fence system comprising:

a plurality of upper struts, seated on a respective fence-post top of at least one of said fence posts, and a plurality of lower struts each engaged with at least one of said two opposite vertical-bracket bodies, and with at least one of said L-shaped-bracket bodies.

11. The fence-post system of claim 10, wherein, each of said angled openings has a dumb-bell shape or a key-hole shape.

12. The fence-post system of claim 10, wherein, each of said upper and lower flange bodies has a generally rectangular shape or a generally square shape.

13. The fence-post system of claim 10, wherein, each of said anti-bending-and-anti-warping ribs is vertical.

14. The fence-post system of claim 10, wherein, each of said anti-clockwise-torsion-and-anti-counterclockwise-torsion ribs is angled.

15. The fence-post system of claim 10, further, comprising at least one powder-coat applied on said fence posts, said upper flange bodies, and said lower flange bodies.

16. The fence-post system of claim 10, further, comprising a base-coat, a gel-coat, and a top-coat applied on each of said fence posts, said upper flange bodies, and said lower flange bodies.

17. A fence-post system comprising:

a plurality of fence posts, each comprising:

a central section, two opposite flank sections molded to ends of said central section to form a U shape, and a plurality of openings punch-pressed in said two opposite flank sections, a plurality of anti-bending-and-anti-warping ribs formed on said central sections of said fence posts, a plurality of anti-clockwise-torsion-and-anti-counterclockwise-torsion ribs formed on said central sections of said fence posts, two opposite vertical-bracket bodies molded to ends of said two opposite flank sections respectively, opposite the central section, with a plurality of vertical-bracket holes drilled in said vertical-bracket bodies respectively, two opposite upper flange bodies, said two opposite flank sections having two opposite upper ends, said two opposite upper flange bodies molded to said two opposite upper ends respectively, with a plurality of upper flange holes drilled in said two opposite upper flange bodies respectively, two opposite lower flange bodies, said two opposite flank sections having two opposite lower ends, said two opposite lower flange bodies molded to said two opposite lower ends respectively, with a plurality of lower flange holes drilled in said two opposite lower flange bodies respectively;

an L-shaped bracket system comprising:

a plurality of L-shaped-bracket bodies, a plurality of L-shaped-bracket hooks molded to said L-shaped-bracket bodies respectively, and a plurality of L-shaped-bracket fangs molded to said L-shaped-bracket hooks respectively, wherein said L-shaped-bracket bodies are attached to said fence posts by rotatingly engaging said L-shaped-bracket hooks into said openings such that a portion of the L-shaped-bracket bodies extends outward from a respective one of said two opposite flank sections; and a fence system comprising:

a plurality of upper struts, each seated on a respective fence-post top of at least one of said fence posts, and a plurality of lower struts each engaged with at least one of said two opposite vertical-bracket bodies, and with at least one of said L-shaped-bracket bodies.

18. The fence-post system of claim 17, wherein, each of said openings has a dumb-bell shape or a key-hole shape.

19. The fence-post system of claim 17, wherein, each of said upper flange bodies has a generally rectangular shape or a generally square shape.

20. The fence-post system of claim 17, further, comprising a base-coat, a gel-coat, and a top-coat applied on each of said fence posts and said upper flange bodies.

* * * * *